US011930936B2

(12) United States Patent
Fritze

(10) Patent No.: US 11,930,936 B2
(45) Date of Patent: Mar. 19, 2024

(54) FABRIC FOR MODULAR CHAIR

(71) Applicant: DV8 ID S.R.L., Milan (IT)

(72) Inventor: Torsten Fritze, Cernobbio (IT)

(73) Assignee: DV8 ID S.R.L., Milan (IT)

( * ) Notice: Subject to any disclaimer, the term of this patent is extended or adjusted under 35 U.S.C. 154(b) by 124 days.

(21) Appl. No.: 17/597,410

(22) PCT Filed: Jul. 9, 2020

(86) PCT No.: PCT/IB2020/056462
§ 371 (c)(1),
(2) Date: Jan. 5, 2022

(87) PCT Pub. No.: WO2021/005550
PCT Pub. Date: Jan. 14, 2021

(65) Prior Publication Data

US 2022/0287476 A1 Sep. 15, 2022

(30) Foreign Application Priority Data

Jul. 11, 2019 (IT) ..... 102019000011508

(51) Int. Cl.
*A47C 7/28* (2006.01)
*A47C 5/06* (2006.01)
(Continued)

(52) U.S. Cl.
CPC ..... *A47C 31/023* (2013.01); *A47C 5/06* (2013.01); *A47C 7/282* (2013.01); *A47C 7/46* (2013.01);
(Continued)

(58) Field of Classification Search
CPC ..... A47C 7/282
(Continued)

(56) References Cited

U.S. PATENT DOCUMENTS 2,839,126 A 6/1958 O'Neill
3,513,492 A * 5/1970 Phillips ..... A47C 7/742 297/452.44
(Continued)

FOREIGN PATENT DOCUMENTS

DE 7800948 U1 6/1979
DE 102014003099 A1 9/2015
(Continued)

OTHER PUBLICATIONS

The International Search Report and Written Opinion, dated Sep. 1, 2020 to DV8 ID S.R.L. for PCT/IB2020/056462.

*Primary Examiner* — Rodney B White
(74) *Attorney, Agent, or Firm* — Vorys, Sater, Seymour and Pease LLP

(57) ABSTRACT

Fabric for a modular chair suitable for defining a surface in use and for supporting a user when seated on the chair, and a perimeter area defined by edges of the surface. The fabric includes, at the surface, a periodic weave, the base of which includes at least one main filament, inside of which at least one secondary filament is also inserted, arranged in a weft along a predetermined trajectory. The main filament and the secondary filament are mutually and tightly attached at the perimeter area. The fabric includes at least one spool defining a long element trapped inside part of the fabric along the perimeter area wherein the weaving of the main filament creates a tubular shape suitable for housing the spool, and the secondary filament at least partially wraps the spool to mutually block the main filament and the secondary filament at the spool.

15 Claims, 18 Drawing Sheets

(51) Int. Cl.

| | |
|---|---|
| ***A47C 7/46*** | (2006.01) |
| ***A47C 31/02*** | (2006.01) |
| ***D04B 1/12*** | (2006.01) |
| *A47C 4/28* | (2006.01) |
| *A47C 5/10* | (2006.01) |

(52) U.S. Cl.
CPC ..... *D04B 1/123* (2013.01); *A47C 4/283* (2013.01); *A47C 5/10* (2013.01); *D10B 2505/08* (2013.01)

(58) Field of Classification Search
USPC ..... 66/166 A–169 R
See application file for complete search history.

(56) References Cited

U.S. PATENT DOCUMENTS 4,803,118 A * 2/1989 Sogi ..... A47C 27/16 442/213
5,013,089 A * 5/1991 Abu-Isa ..... B60N 2/7094 297/452.64
5,318,348 A * 6/1994 Hess ..... A47C 31/023 297/440.11
5,457,968 A * 10/1995 McClintock ..... D04B 21/18 66/190
5,716,101 A * 2/1998 Frinier ..... A47C 5/06 297/440.22
5,762,403 A 6/1998 Robinson
6,125,521 A * 10/2000 Stumpf ..... A47C 1/0303 29/559
6,293,624 B1 9/2001 Gaylord et al.
6,779,849 B1 * 8/2004 Harper ..... A47C 7/282 297/440.11
7,740,320 B2 * 6/2010 Chiang ..... A47C 4/03 297/440.22
RE43,919 E * 1/2013 Chen ..... A47D 7/00 5/98.1
10,159,351 B1 * 12/2018 Alexander ..... A47C 7/32
10,681,992 B2 * 6/2020 Wang ..... A47C 7/28
2002/0043867 A1 * 4/2002 Lessmann ..... A47C 23/12 297/452.64
2003/0042783 A1 * 3/2003 Potes ..... A47C 31/023 297/452.56
2003/0102707 A1 * 6/2003 Schwartz ..... D02G 3/28 297/451.9
2003/0221741 A1 * 12/2003 Schwartz ..... D03D 1/00 139/426 R
2004/0031534 A1 * 2/2004 Schwartz ..... A47C 7/02 139/169
2004/0121684 A1 * 6/2004 Haun ..... B32B 3/12 442/187
2004/0124689 A1 * 7/2004 Numa ..... A47C 31/023 297/452.56
2006/0255645 A1 * 11/2006 Coffield ..... A47C 7/029 297/452.13
2013/0088065 A1 * 4/2013 Narita ..... D03D 15/56 442/203
2015/0173514 A1 * 6/2015 Kikuchi ..... A47C 5/02 297/451.9
2016/0128484 A1 * 5/2016 Gross ..... B32B 27/36 442/221
2016/0206102 A1 * 7/2016 Aldrich ..... A47C 7/282
2018/0245248 A1 * 8/2018 Buffington ..... D03D 9/00
2020/0039399 A1 * 2/2020 Oomen ..... B60N 2/5891
2020/0323357 A1 * 10/2020 Case ..... A47C 31/02
2021/0227992 A1 * 7/2021 Oomen ..... D03D 1/00
2022/0167756 A1 * 6/2022 Fritze ..... A47C 31/00

FOREIGN PATENT DOCUMENTS

EP 1092798 A2 4/2001
GB 2193980 A 2/1988
JP 2015221112 A 12/2015

* cited by examiner

*Fig. 3*
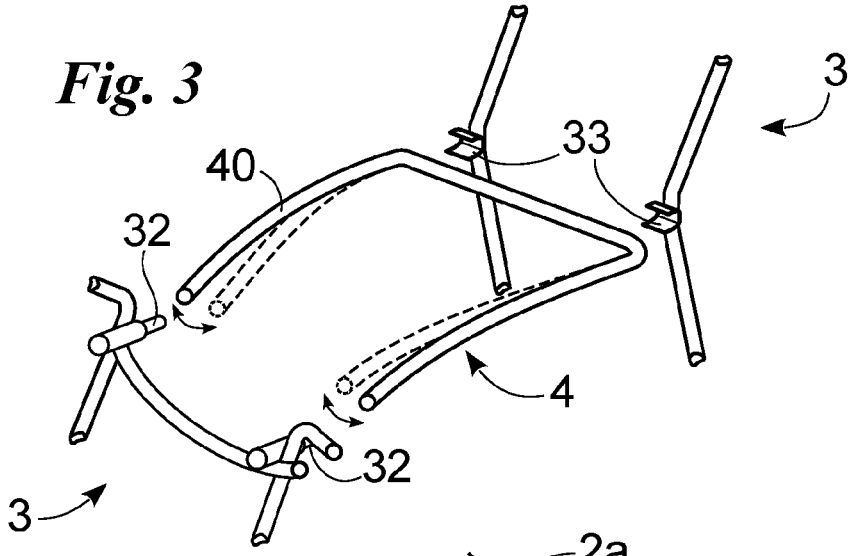
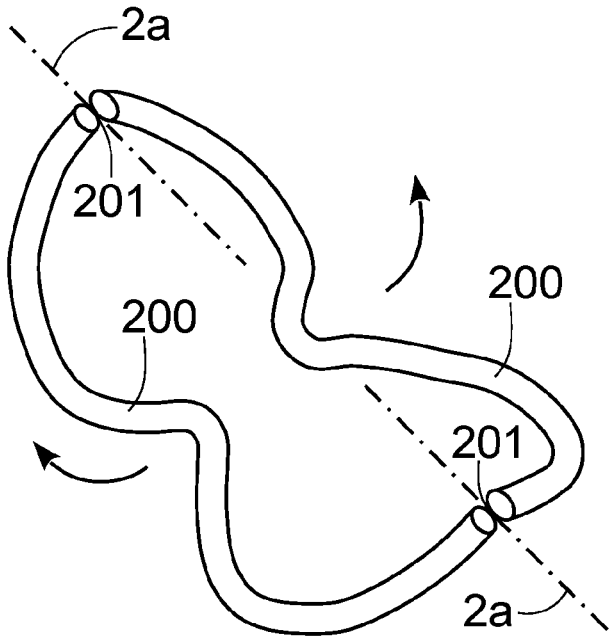
*Fig. 4*
*Fig. 5a*
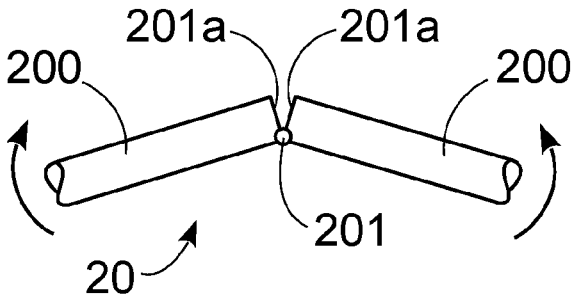
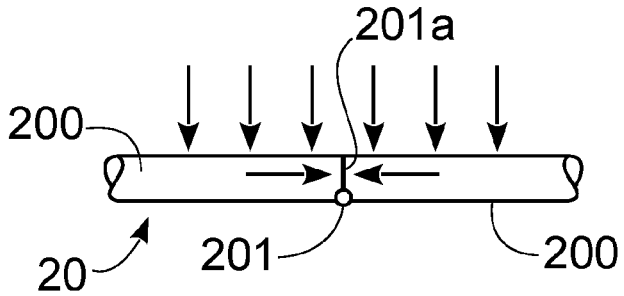
*Fig. 5b*

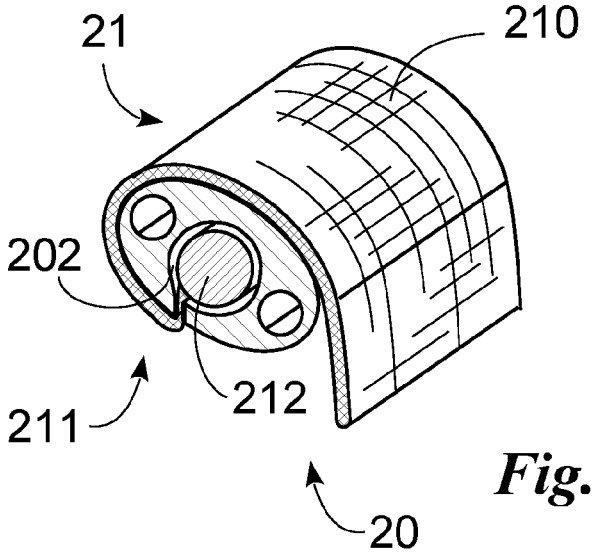
Fig. 6
Fig. 7
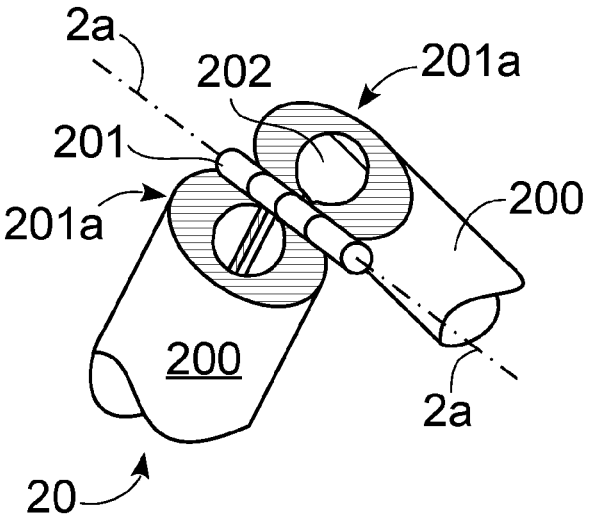
Fig. 8
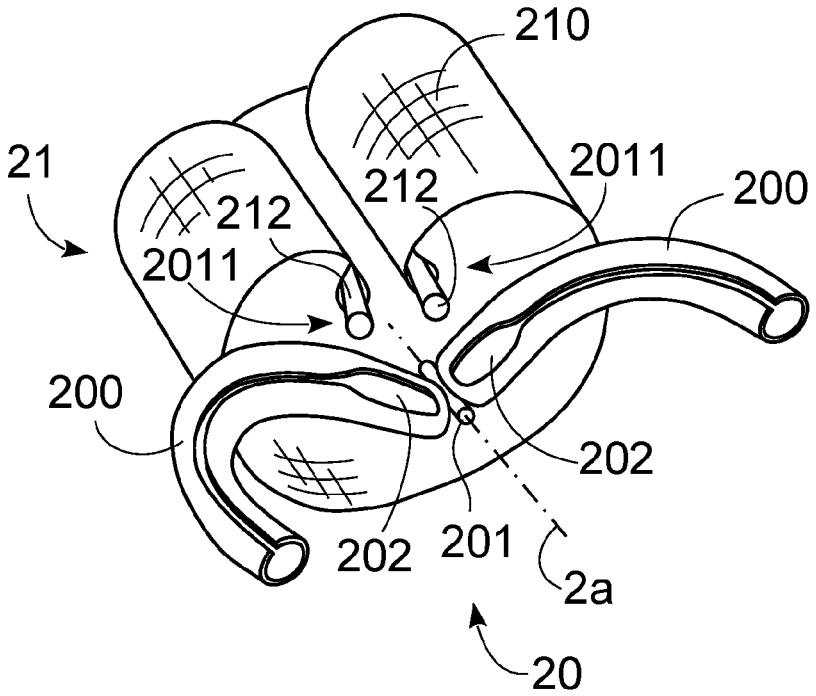

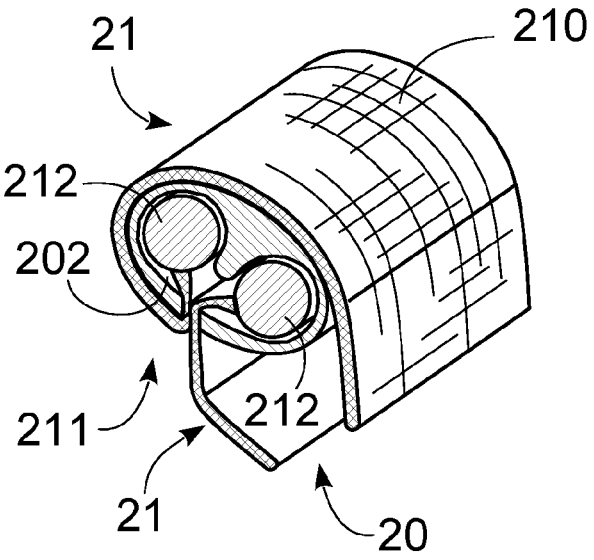
Fig. 9a
Fig. 9b
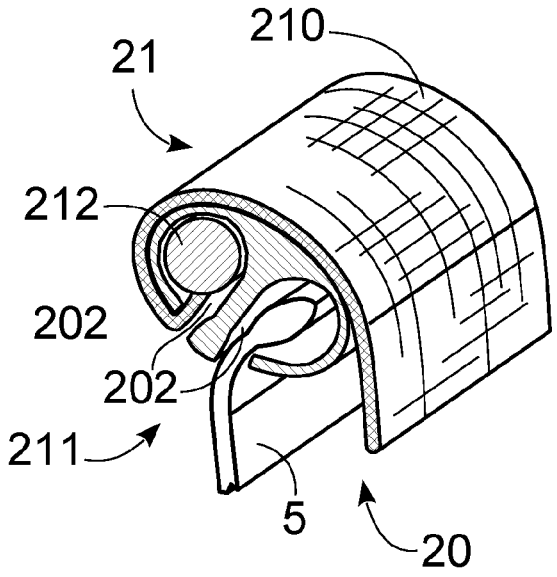
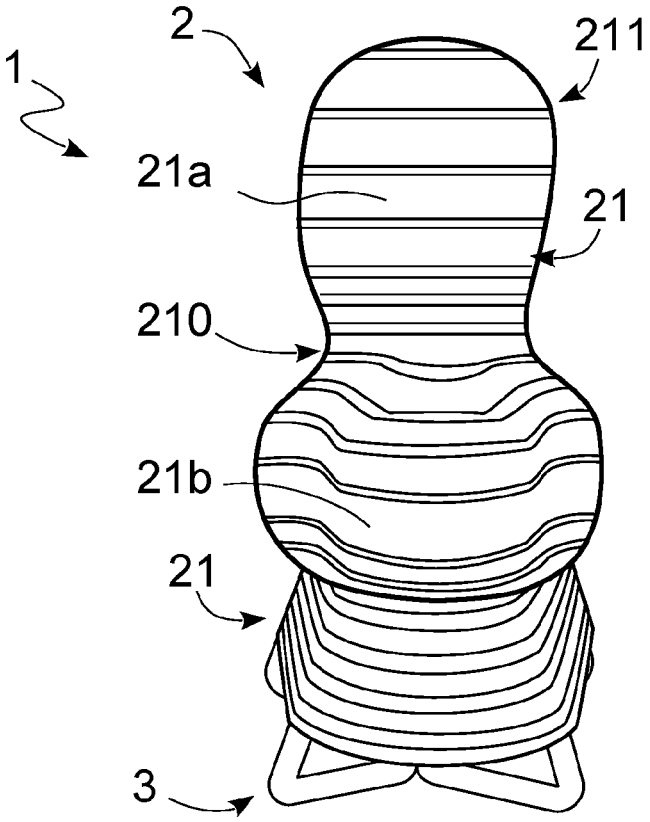
Fig. 10

*Fig. 13a*
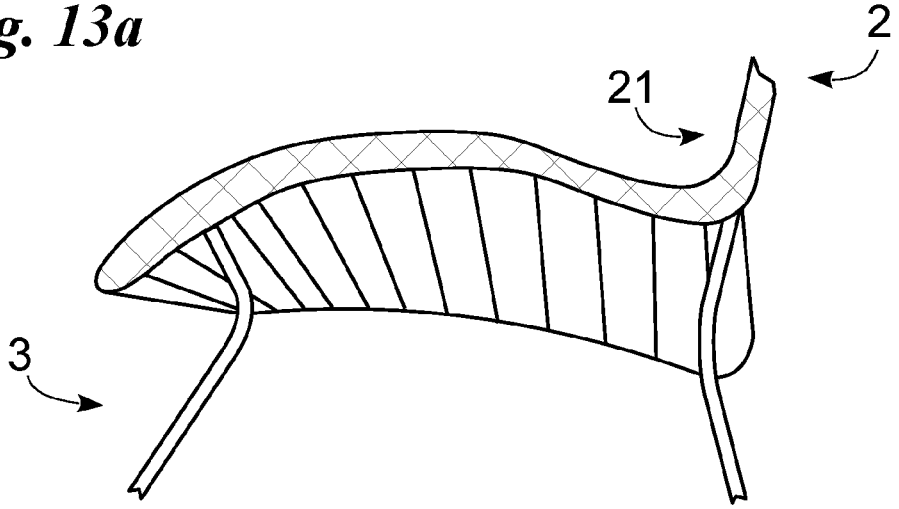
*Fig. 13b*
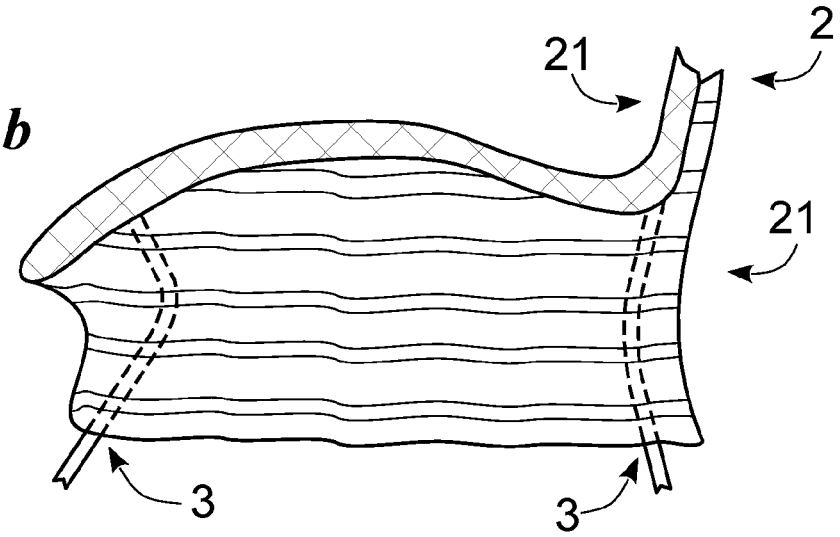
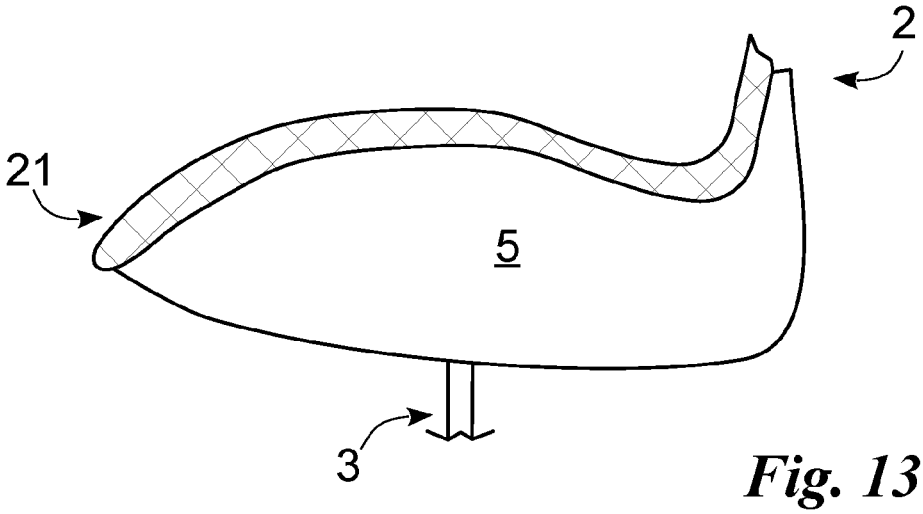
*Fig. 13c*

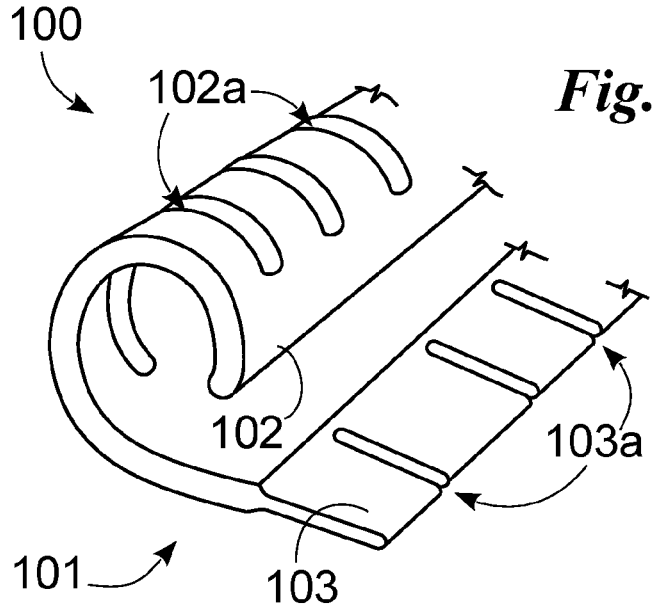
Fig. 14
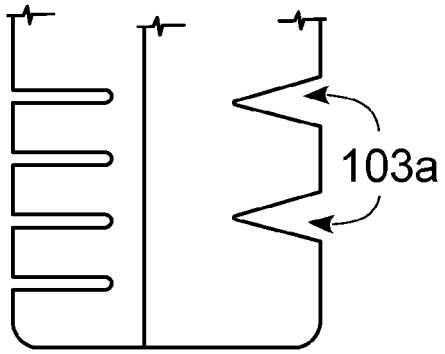
Fig. 15
Fig. 16
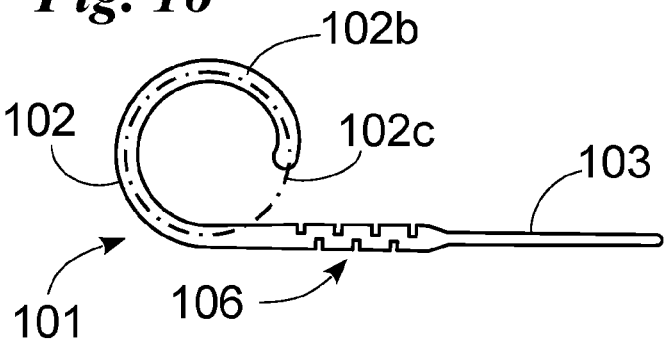
Fig. 17a
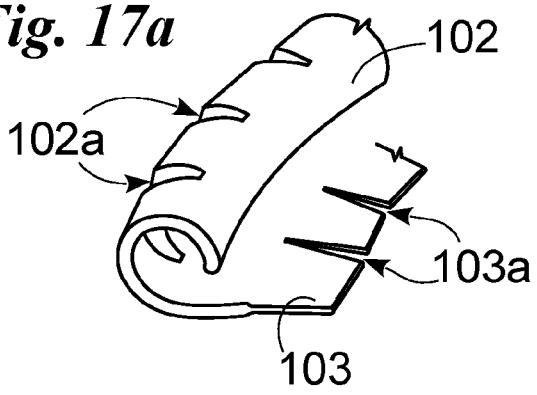
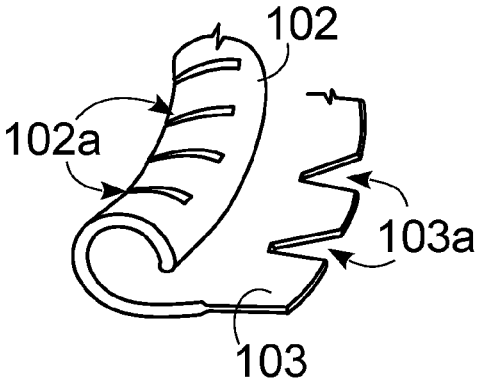
Fig. 17b

*Fig. 18*
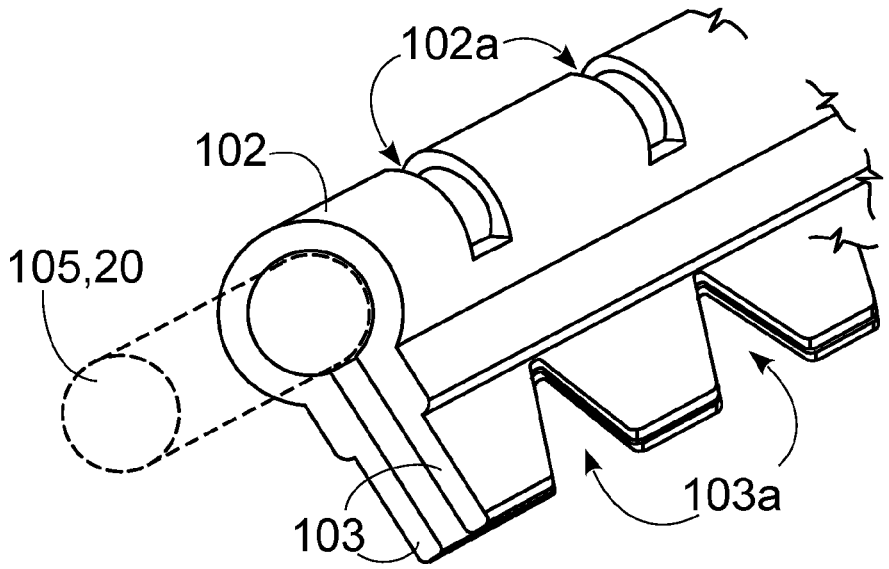
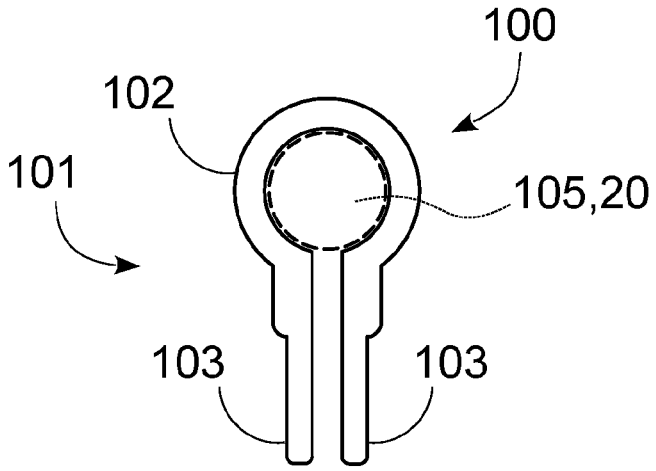
*Fig. 19*

*Fig. 21a*
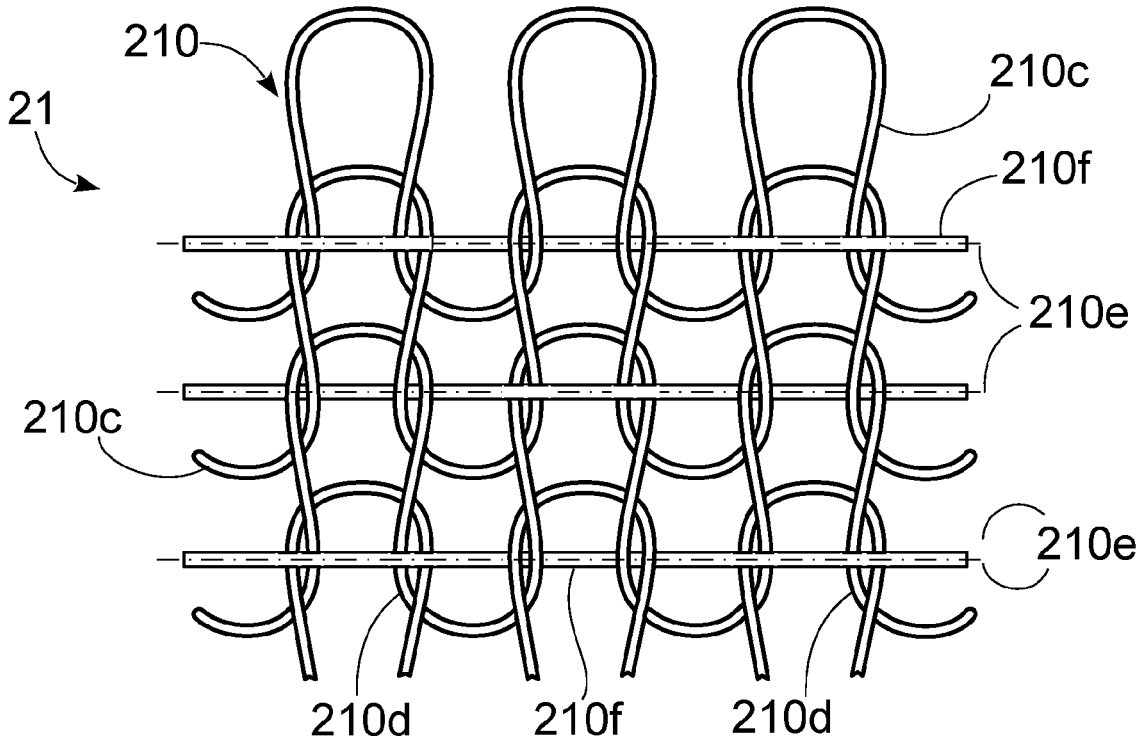
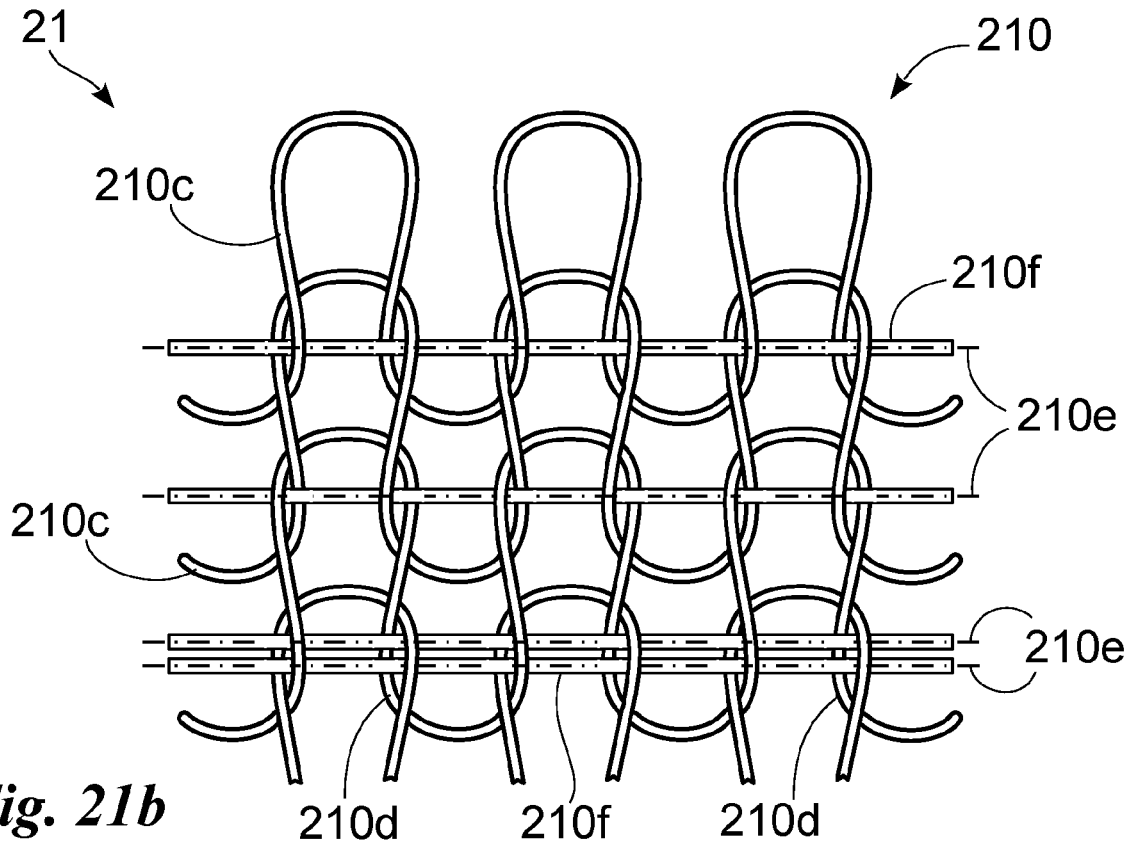
*Fig. 21b*

*Fig. 22*
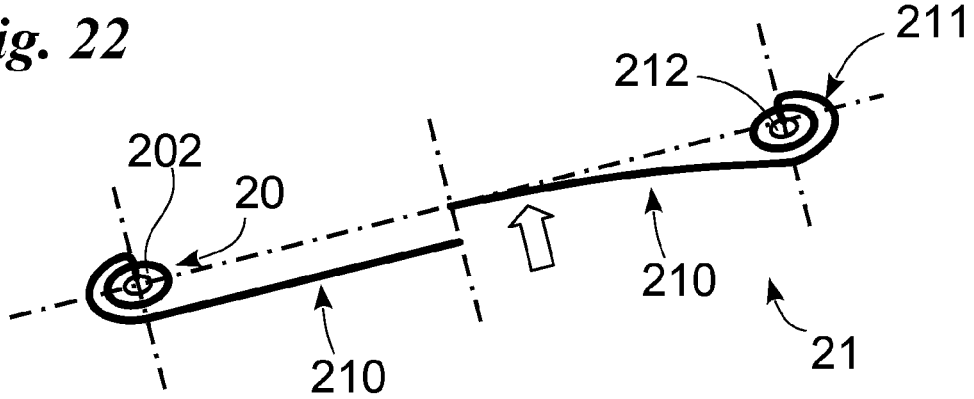
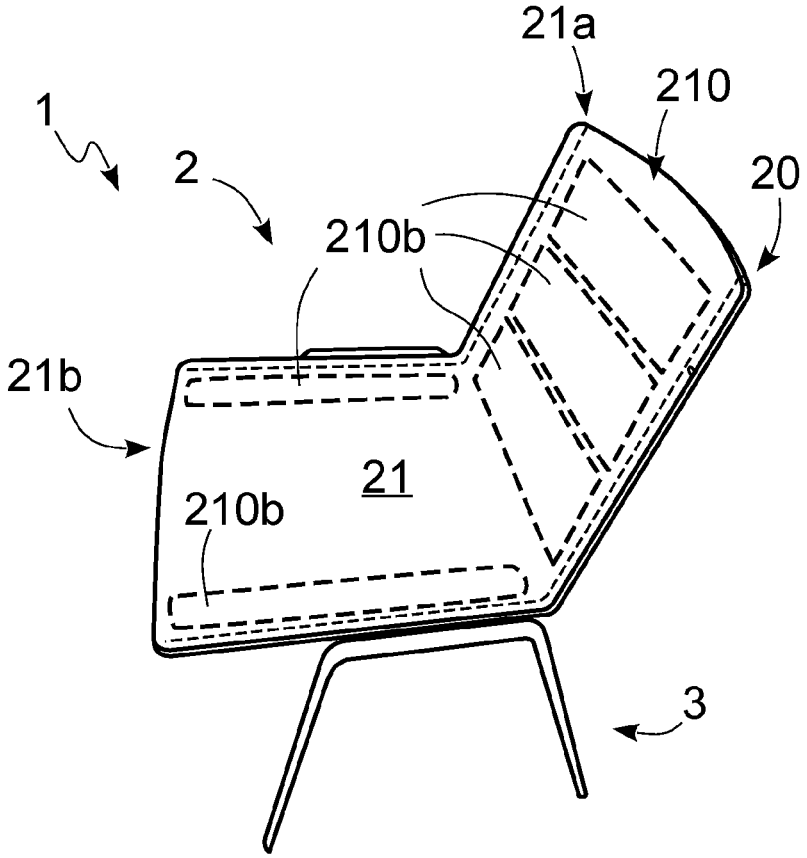
*Fig. 23*

*Fig. 27*
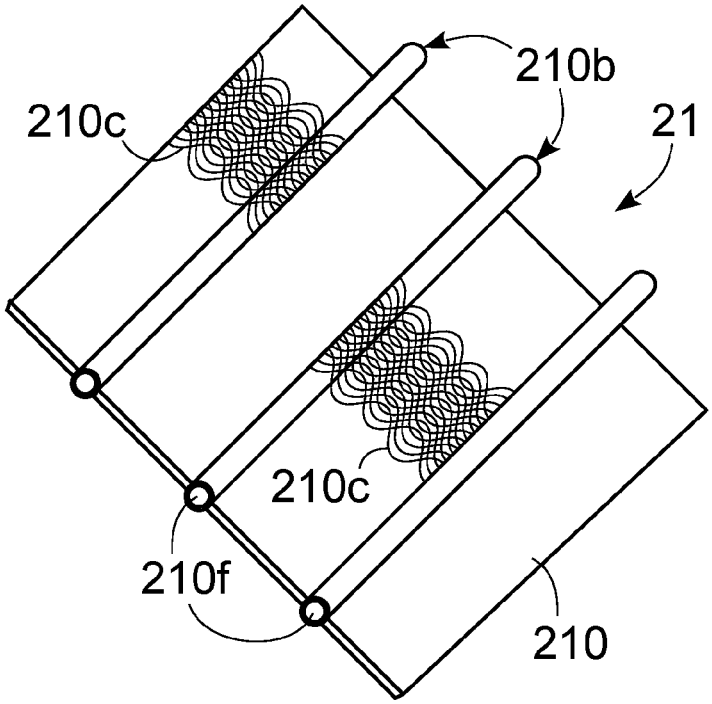
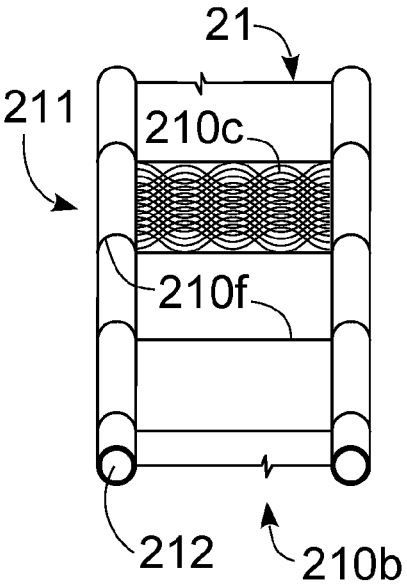
*Fig. 28*

*Fig. 29a*
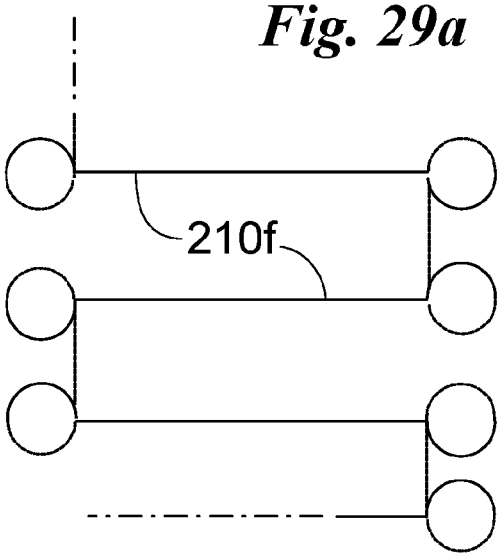
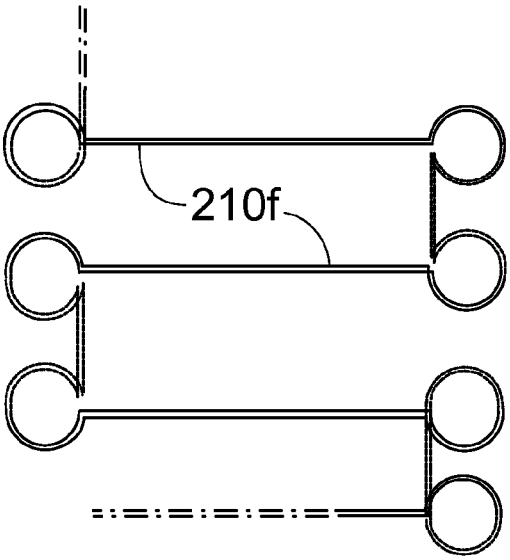
*Fig. 29b*
*Fig. 29c*
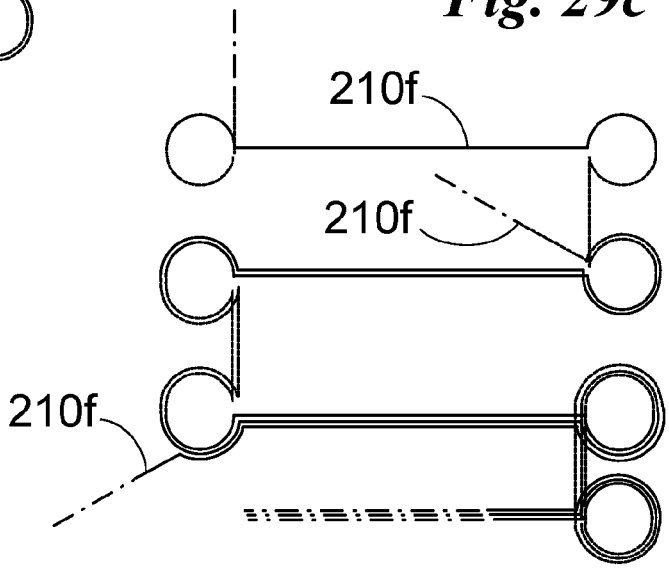

FABRIC FOR MODULAR CHAIR

This invention relates to a fabric for a modular chair of the type specified in the preamble of the first claim.

In particular, this invention relates to a fabric for a chair of the modular type. In this text, the term "chair" is, in the broadest sense of the term, any device that enables a user to sit and that may, depending on the configuration, consist of a chair, an armchair, a sofa, or something else for various types of application, including the office, home, garden, luxury, and so on.

As is well known, in the present state of the art, many different types of chairs have been produced, for example with armrests, recliners, slings, or armchairs or sofas and so on, according to the reference market for which the chairs are intended.

Historically, chairs are derived from simple benches. The latter are in fact equipped with a simple support plane defining the seat structurally connected to at least two support pillars to allow the seat to be raised from the floor.

Currently, chairs are typically designed to allow the support of at least one user, and preferably one, on a plane called a seat. Most chairs also have additional resting elements, such as the backrest, and may also comprise armrests and supports for the support of the upper and lower limbs respectively.

Among the various widespread types of chairs are the so-called deck chair, consisting of a folding chaise lounge the backrest of which can be reclined at variable angles and on which a sitting or lying position may be taken, as desired by the user, the curule seat, also developed as the faldstool, with a substantially crossed, or X structure, and sometimes folding for the support of the seat, the tripolina entirely folding and used historically in battlefields, the monobloc chair generally made of polymeric material and used for outdoor environments, mainly in the restaurant industry, the rocking chair comprising two curved supports designed to allow the rocking movement typical of the chair in question, and the cantilever chair, very commonly used and comprising only two uprights bent at floor level and at seat level and connected horizontally by a continuous tube.

In addition to the above examples are a number of other different types and structures of chair designed to meet aesthetic needs, such as the market demand for a certain shape, or technical needs, resulting for example from the need to optimize the production process while maintaining high quality levels of the chair product.

Examples of this type are described in the patent applications EP-A-1092798 and GB-A-2193980.

The chairs described in the above patent applications have such features and configurations as to allow the manufacture of chair seats and backrests with sections having different mechanical properties.

In particular, all chairs have the option of adapting a portion of fabric to the required or optimal rigidity or elasticity for the part of the chair that the fabric covers or forms, therefore, making chairs the support surface of which has areas with different elasticity.

In detail, the application EP-A-1092798 describes a knitted fabric wherein portions of the knitted fabric are made of filaments with different properties in such a way as to produce areas of greater or lesser pliability. This technology is also implemented within a seat with a sock coupling, i.e. by arranging a sock on a pre-formed structure. The patent application GB-A-2193980, on the other hand, describes a fabric, potentially available for example on a chair backrest, wherein portions with different properties are present due to the increase or decrease in the density of the weave. A significant drawback of the above-mentioned techniques is that the portions of fabric with different elasticities are visible to the naked eye. Therefore, in a sector such as design, wherein the aesthetic form is relevant to the marketability of the chair, the fact of covering a pre-formed structure with irregular material can have a significant impact on the success of any chair.

In addition, the fabric-manufacturing methods already described lead to a substantial unevenness in the fabric surface with consequences for the user's comfort when seated.

In addition, the methods for coupling the fabrics to the structure significantly reduce the technical effect or the benefits of using such fabrics since, for example, in a sock configuration, they permit an uncontrolled release of the fabric from the structure.

In this situation, the technical task underlying this invention is to devise a fabric for a modular chair able to substantially overcome at least some of the drawbacks mentioned above. In particular, an important technical task is that of offering a superior performance in terms of comfort and appearance.

In the context of this technical task, an important purpose of the invention is to obtain a modular chair fabric that enables the creation of areas of the seat or backrest characterised by different mechanical properties without impacting the external appearance of the fabric.

Another important purpose of the invention is to create a modular chair fabric with sufficient surface regularity, in conjunction with the previous advantages, so that the user does not perceive any irregularity in the mechanical characteristics when sitting.

In conclusion, an additional purpose of the invention is to make a chair fabric that can be coupled to the structure of a chair in such a way as to control the release of the fabric itself.

The technical task and specified purposes are achieved by a modular chair fabric as claimed in the appended claim 1.

Preferred technical embodiments are highlighted in the dependent claims.

The characteristics and benefits of the invention will be clarified in the following detailed description of some preferred embodiments of the invention, with reference to the accompanying drawings, wherein:

FIG. 3 is the detail of the stretcher and the support portion of a chair according to the invention;

FIG. 4 is a schematic view in perspective of the frame of a chair according to the invention;

Figure 1:
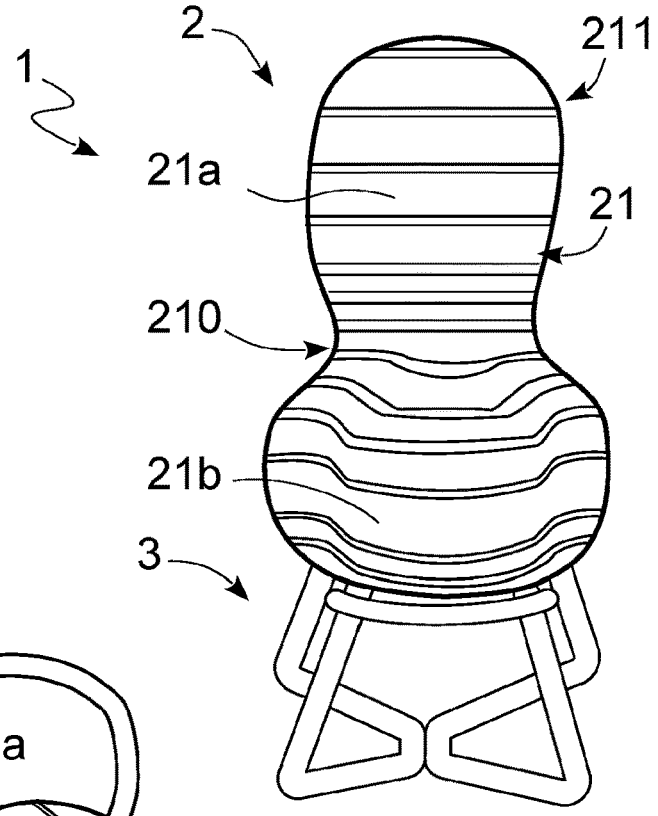
FIG. 1 shows a front view of a chair according to the invention.
Figure 2:
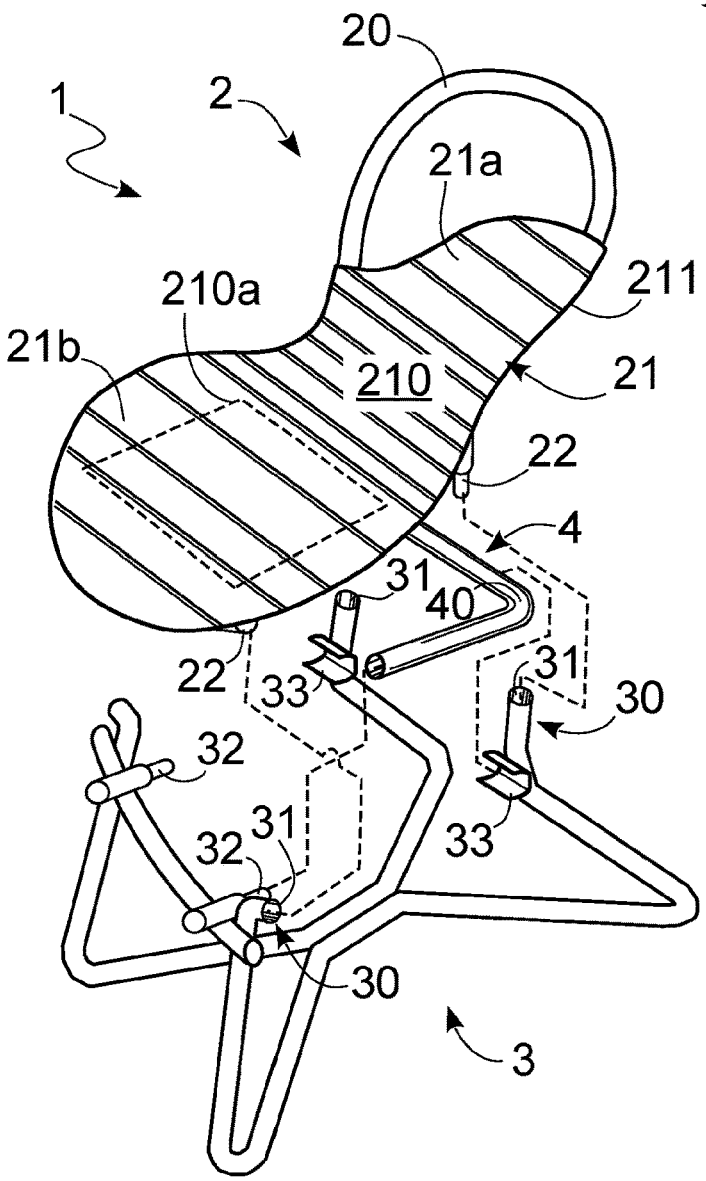
FIG. 2 shows an exploded view of a chair according to the invention.
Figure 11:
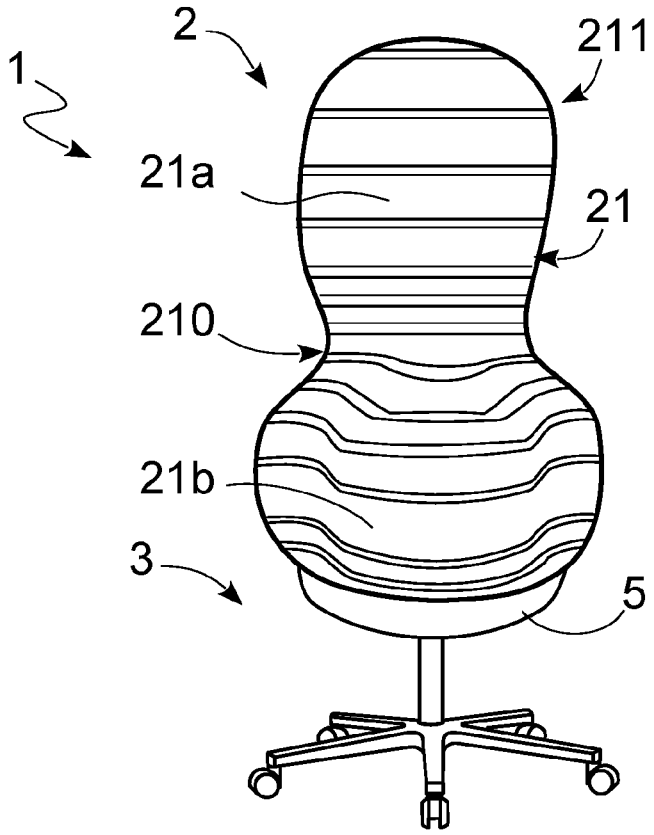
Figure 12:
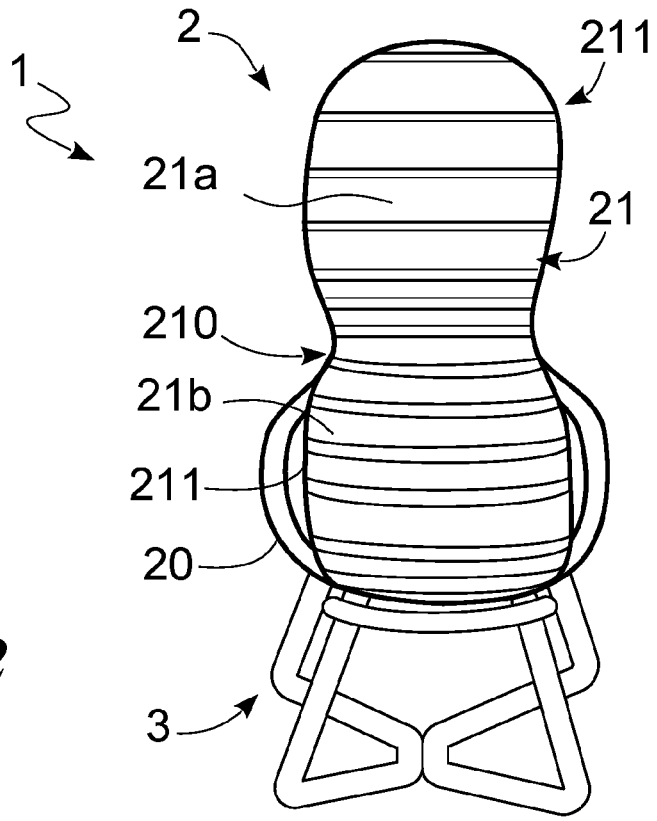
Figure 20A:
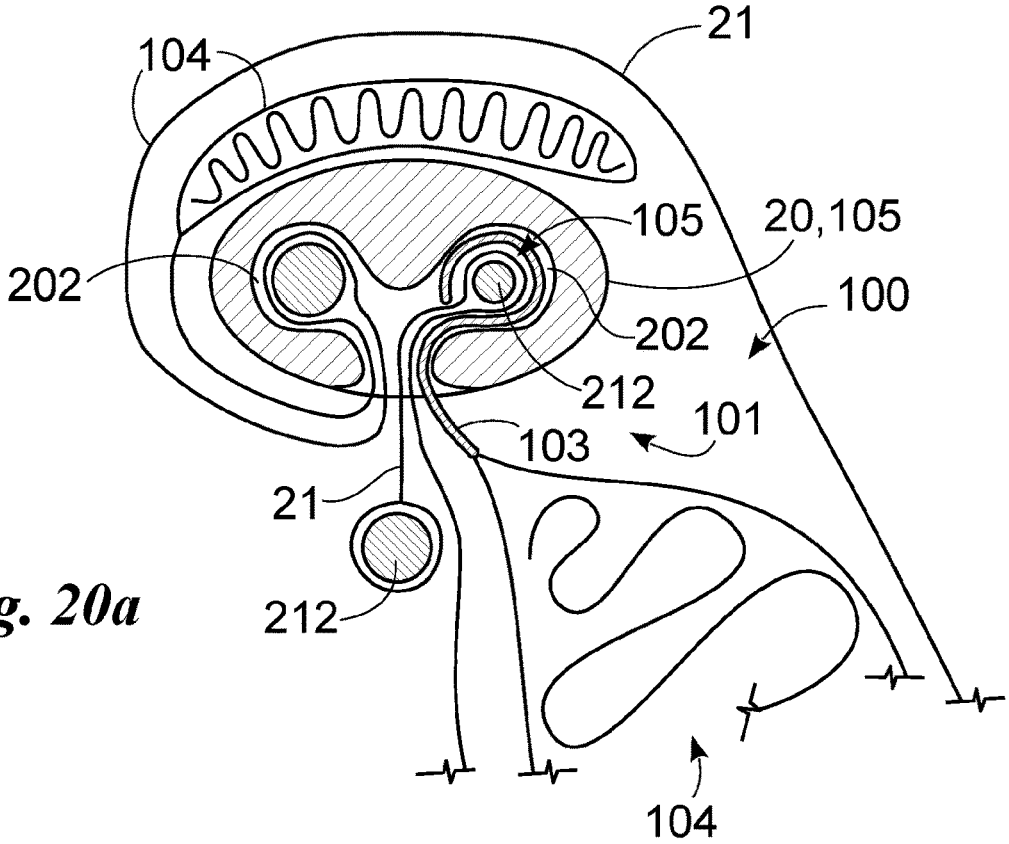
Figure 20B:
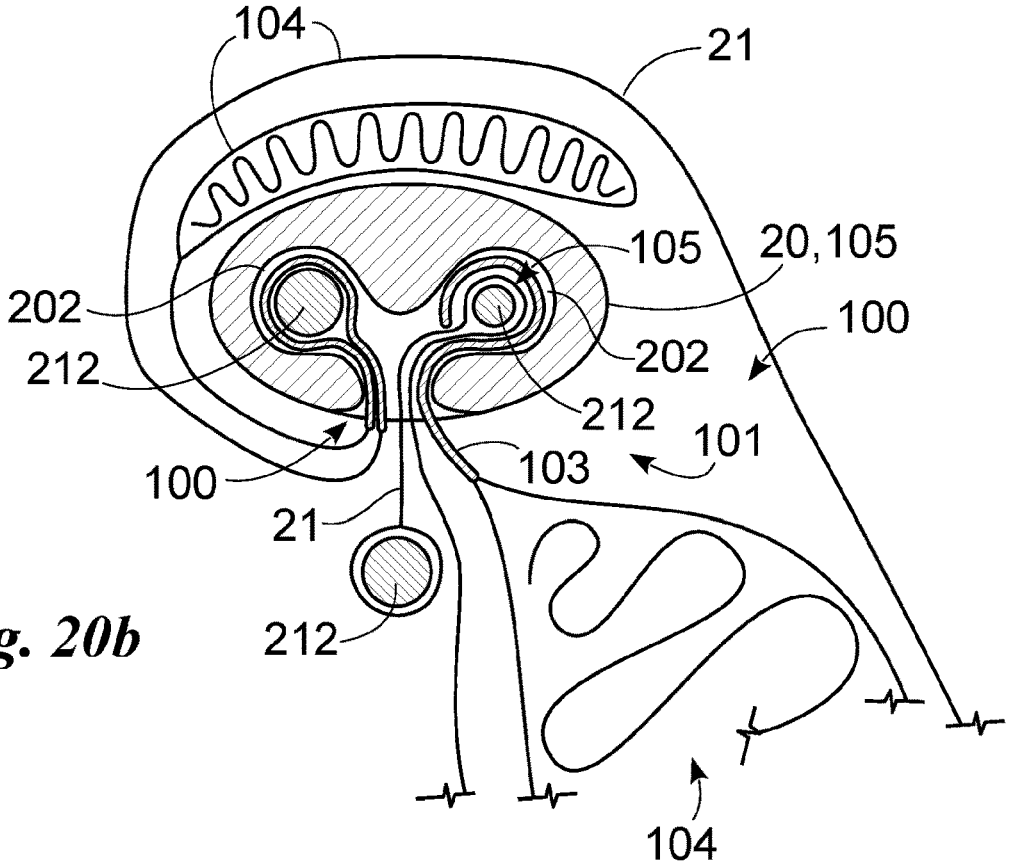
Figure 24:
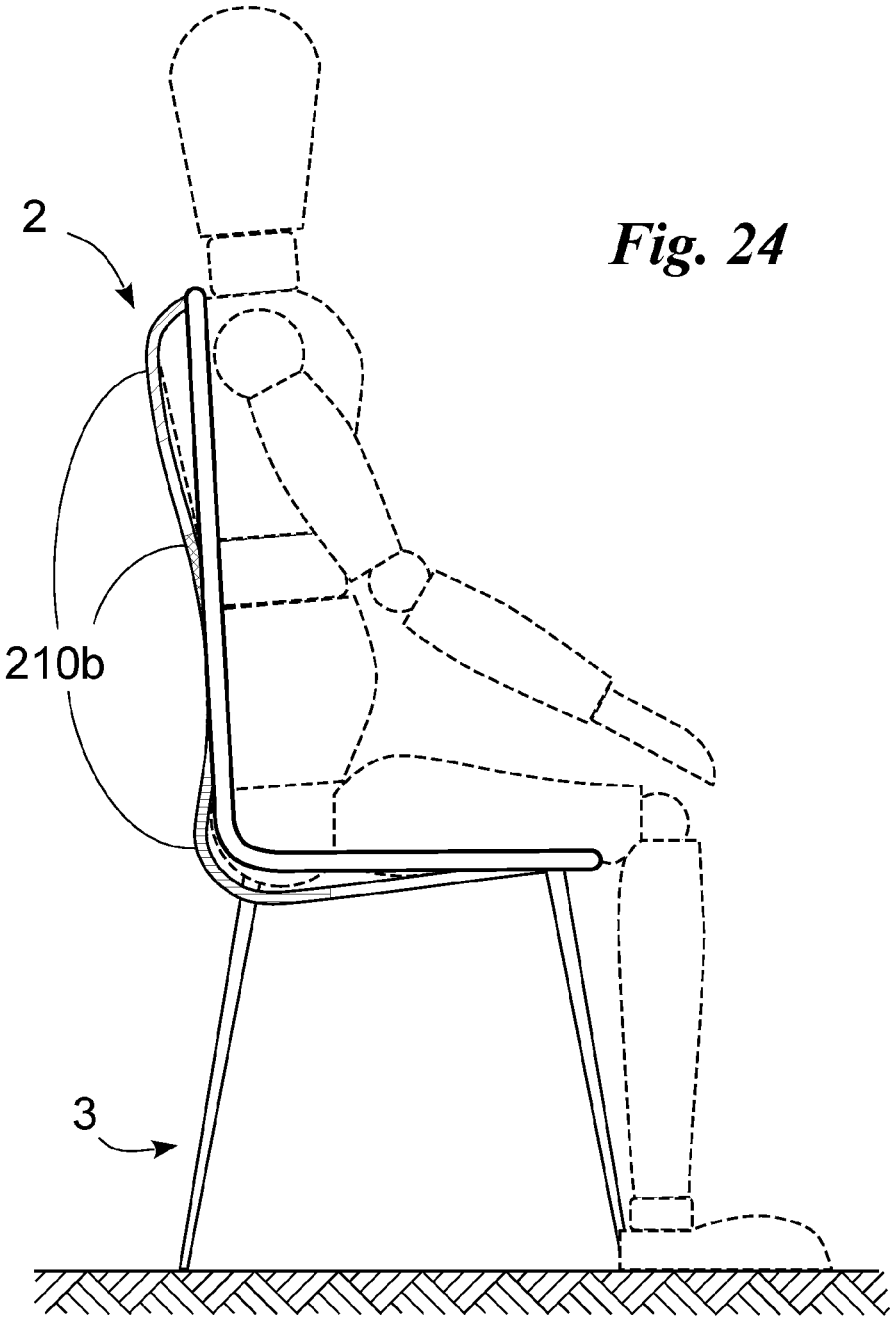

FIG. 5*a* shows the detail of the mechanism made by the hinge of the frame of a chair according to the invention in the rest or pre-assembly configuration;

FIG. 5*b* shows the detail of the mechanism made by the hinge of the frame of a chair according to the invention in the configuration of use or in the assembled configuration;

FIG. 6 is a cross-section view of the frame of a chair according to the invention with a guide;

FIG. 7 shows the detail of the hinge of a chair according to the invention;

FIG. 8 shows a schematic example of introducing the fabric spools into the frame guide of a chair according to the invention;

FIG. 9*a* shows a cross-section view of the frame of a chair according to the invention with two fabrics connected to the frame in a single guide;

FIG. 9*b* is a cross-section view of the frame of a chair according to the invention with two guides, a fabric and a coupling device in which the fabric and the coupling device are each connected to the frame by means of a special guide;

FIG. 10 is a front view of a chair according to the invention including a fabric covering the bottom of the resting portion;

FIG. 11 shows a front view of a chair according to the invention including a coupling device at the bottom of the resting portion and a support portion in an office embodiment;

FIG. 12 shows a front view of a chair according to the invention including an alternative embodiment in which the fabric is suspended;

FIG. 13*a* is a detailed side view of a chair according to the invention in the preferred embodiment shown in FIGS. 1-2;

FIG. 13*b* is a detailed side view of a chair according to the invention in the alternative embodiment shown in FIGS. 9*a* and 10;

FIG. 13*c* shows a detailed side view of a chair according to the invention in the alternative embodiment shown in FIGS. 9*b* and 11;

FIG. 14 shows a perspective view of an insert for the chair according to the invention;

FIG. 15 shows a view from above of an insert for a chair according to the invention;

FIG. 16 represents a side view of an insert for a chair according to the invention wherein the profile of the coupling zone is highlighted;

FIG. 17*a* shows an example of deformations of an insert for a chair according to the invention for convex structures;

FIG. 17*b* shows an example of deformations of an insert for a chair according to the invention for concave structures;

FIG. 18 is a perspective view of an insert for a chair according to the invention with a double joining zone, but without external bodies;

FIG. 19 represents a side view of the profile of an insert for a chair according to the invention with a double joining zone;

FIG. 20*a* shows an example of applying an insert for a chair according to the invention to a modular chair according to the invention;

FIG. 20*b* illustrates an example of applying two inserts for a chair according to the invention in a modular chair according to the invention wherein one insert has a double joining zone and one insert has a single joining zone;

FIG. 21*a* is a first example of a fabric according to the invention wherein the secondary filament is woven with the main filament along the pick alternating between the obverse and the reverse of the knitted weave without inserting itself in the loops;

FIG. 21*b* is a second example of fabric according to the invention wherein the secondary filament is woven with the main filament through the loops along the pick;

FIG. 22 represents an upper cross-section view of a coupling between frame and fabric according to the invention in a chair provided with a frame with guide;

FIG. 23 shows an embodiment of a chair backrest with the fabric according to the invention;

FIG. 24 shows a side view of a chair including the fabric according to the invention while the chair is in use and with the detail of the selectively deformed backrest in the lumbar and thoracic spine area thanks to the localised areas of the fabric according to the invention.

Figure 25A:
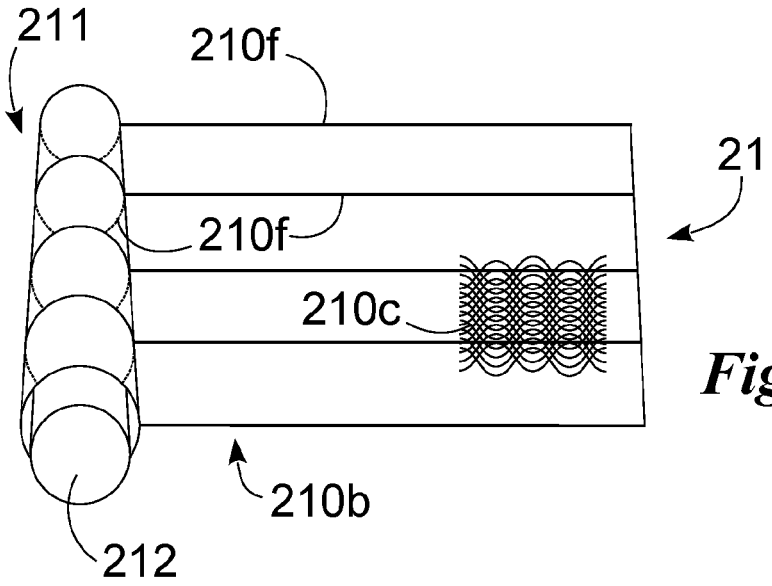
Figure 25B:
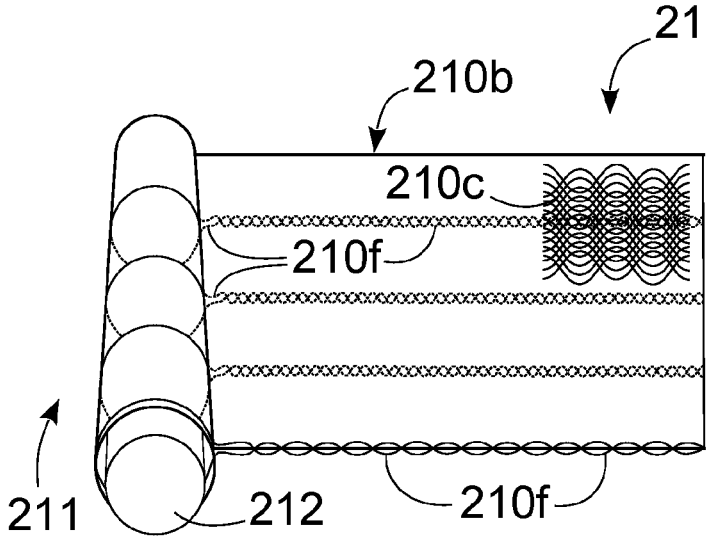
Figure 26A:
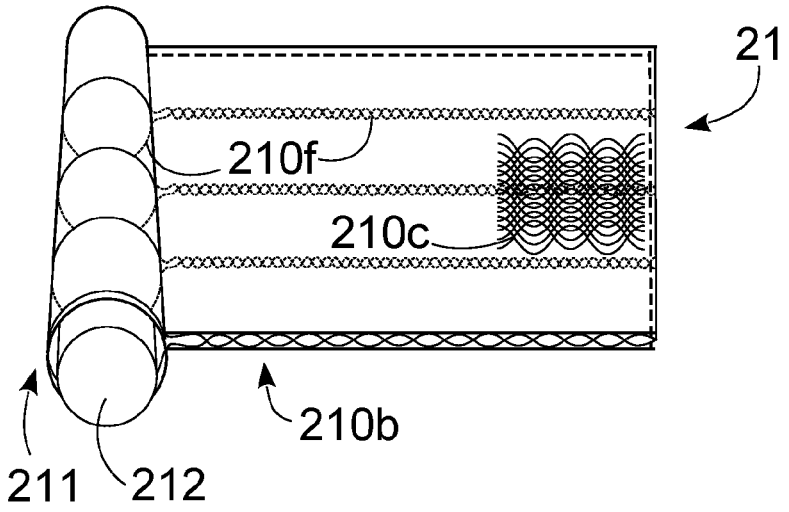
Figure 26B:
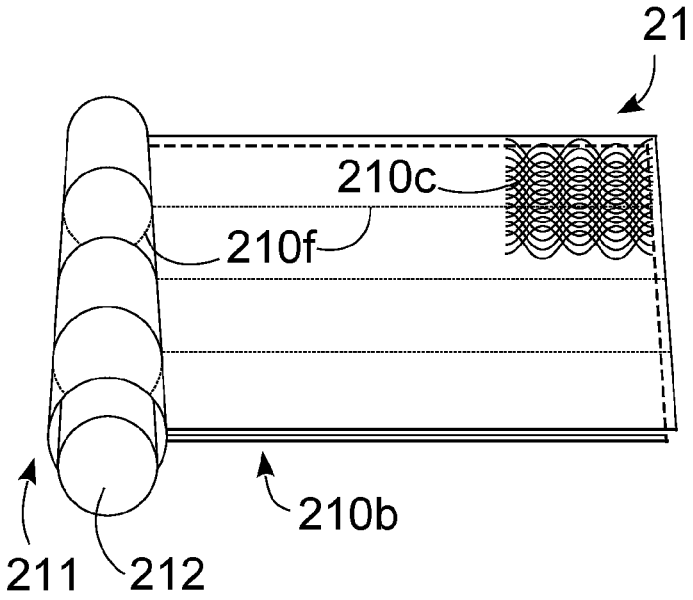
Figure 26C:
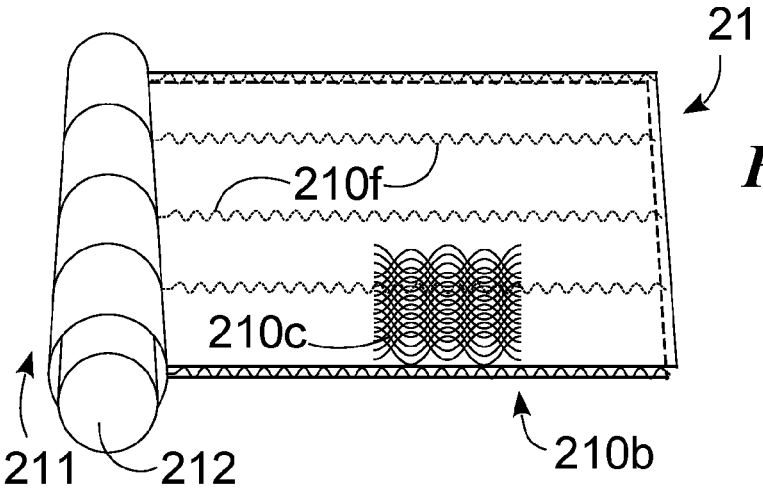
Figure 30A:
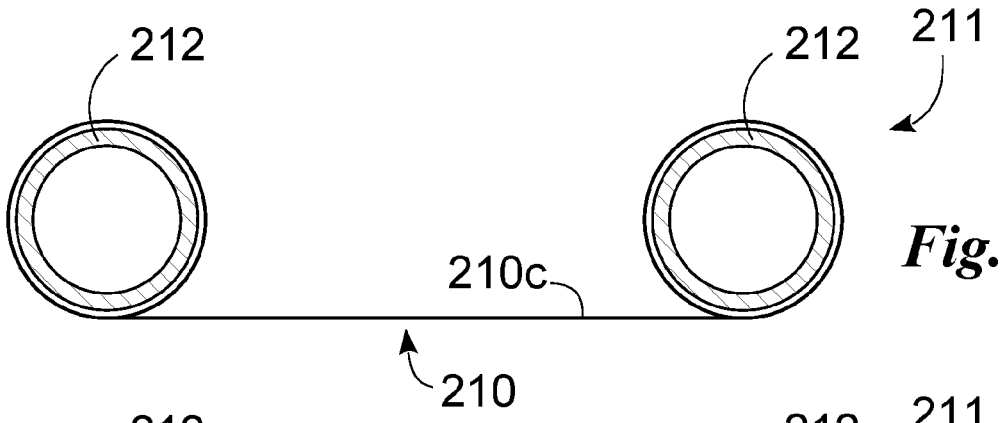
Figure 30B:
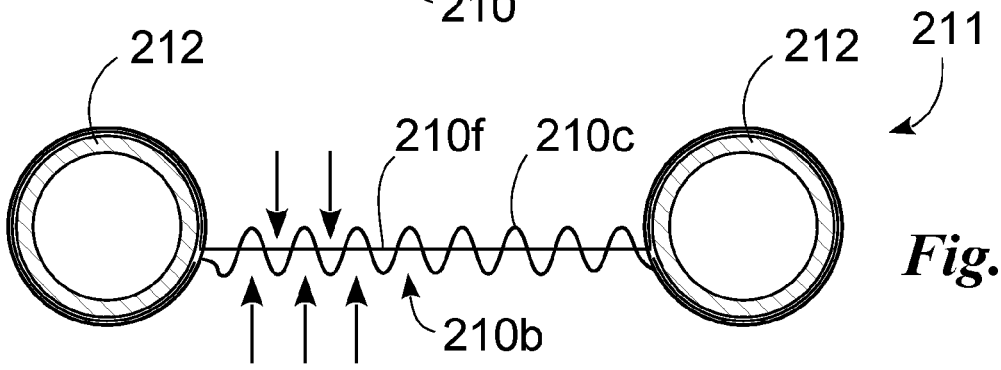
Figure 31A:
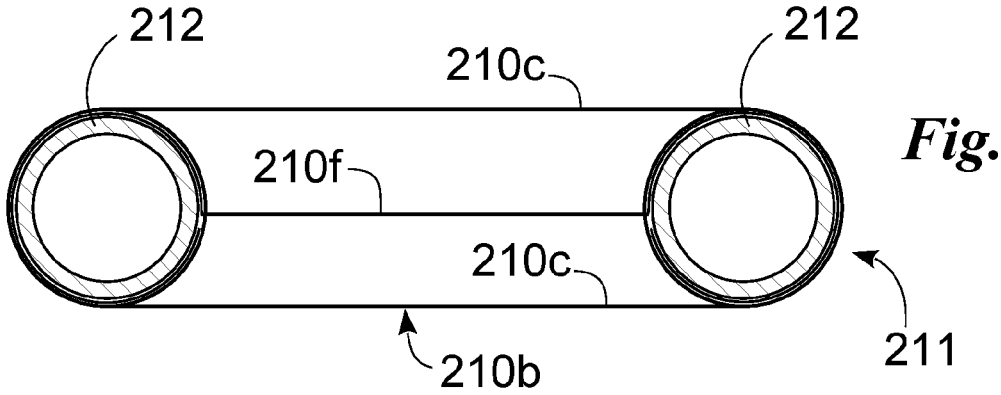
Figure 31B:
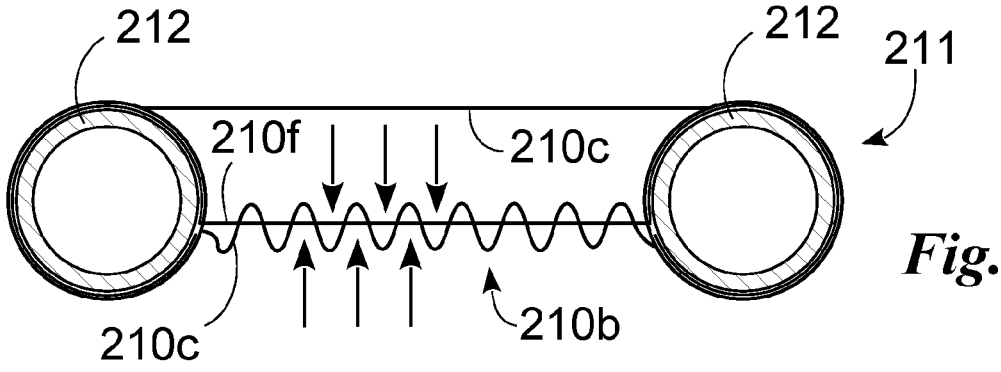

FIG. 25*a* shows an example of a coupling between single-layer knitted weave and secondary yarn woven and completely wound around the spool of a fabric according to the invention;

FIG. 25*b* illustrates an example of a coupling between single-layer knitted weave and secondary yarn woven and partially wound around the spool of a fabric according to the invention wherein the weft in the weave has double secondary yarn;

FIG. 26*a* is an example of a coupling between double-layer knitted weave and secondary yarn woven and partially wound around the spool of a fabric according to the invention wherein the weft in the weave has double secondary yarn and the secondary yarns are placed between the sandwich knitted layers;

FIG. 26*b* an example of a coupling between double-layer knitted weave and secondary yarn woven and completely wound around the spool of a fabric according to the invention wherein the main yarn is placed between the sandwich knitted layers;

FIG. 26*c* shows an example of a coupling between double-layer knitted weave and secondary yarn woven and completely wound around the spool of a fabric according to the invention wherein the main yarn is alternately woven between knit layers;

FIG. 27 illustrates an example of a coupling between single- and/or double-layer knitted weave and woven secondary yarn of a fabric according to the invention wherein the secondary yarn is arranged within tubular portions made from the knitted weave;

FIG. 28 is a fabric pattern according to the invention wherein the localised area is made from a secondary filament that makes a continuous path through the knitted weave made by the secondary filament;

FIG. 29*a* represents a simplified diagram of a continuous path of a secondary filament wherein the winding of the latter around the spool is highlighted and wherein secondary filament gaps parallel to the spool are highlighted;

FIG. 29*b* shows a simplified diagram of a continuous path of two secondary filaments wherein the winding of the latter around the spool is highlighted and wherein secondary filament gaps parallel to the spool are highlighted;

FIG. 29*c* illustrates a simplified diagram of a continuous path of a secondary filament wherein the winding of the latter around the spool is highlighted, wherein secondary filament gaps parallel to the spool are also highlighted, and wherein other secondary filaments, along the various picks, are added;

FIG. 30*a* is a diagram of a fabric, seen in cross-section, according to the invention without any woven thread inside and with only one layer of knitted weave;

FIG. 30*b* represents a diagram of a fabric, seen in cross-section, according to the invention at a localised area wherein a secondary filament is woven, in a weft, in a layer of knitted weave, wherein the secondary filament is partially inserted inside the spool to pass from pick to pick, and wherein the secondary filament is visible on both sides of the knit layer, so that it alternates, as indicated by the arrows;

FIG. 31*a* shows a diagram of a fabric, seen in cross-section, according to the invention at a localised area wherein a secondary filament is embedded, in a weft, between two layers of knitted weave and wherein the secondary filament is partially inserted inside the spool to pass from pick to pick; and FIG. 31*b* illustrates a diagram of a fabric, seen in cross-section, according to the invention at a localised area wherein a secondary filament is woven, in a weft, in a layer of knitted weave, wherein there is a second layer of knitted weave suitable for concealing the secondary filament on one side of the knitted fabric, and wherein the secondary filament is inserted partially inside the spool to pass from pick to pick.

In this document, the measures, values, shapes and geometric references (such as perpendicularity and parallelism), when associated with words like "almost" or other similar terms such as "approximately" or "substantially", are to be understood as except for measurement errors or inaccuracies owing to production and/or manufacturing errors and, above all, except for a slight divergence from the value, measure, shape, or geometric reference with which it is associated. For example, if associated with a value, such terms preferably indicate a divergence of no more than 10% from the value itself.

Figure 32A:
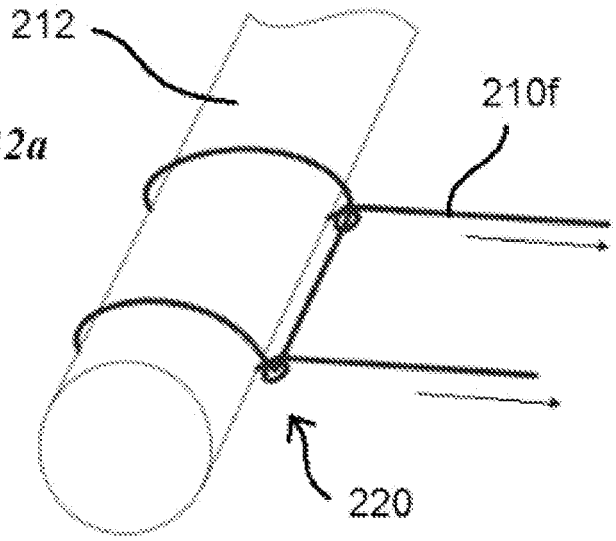
Figure 32B:
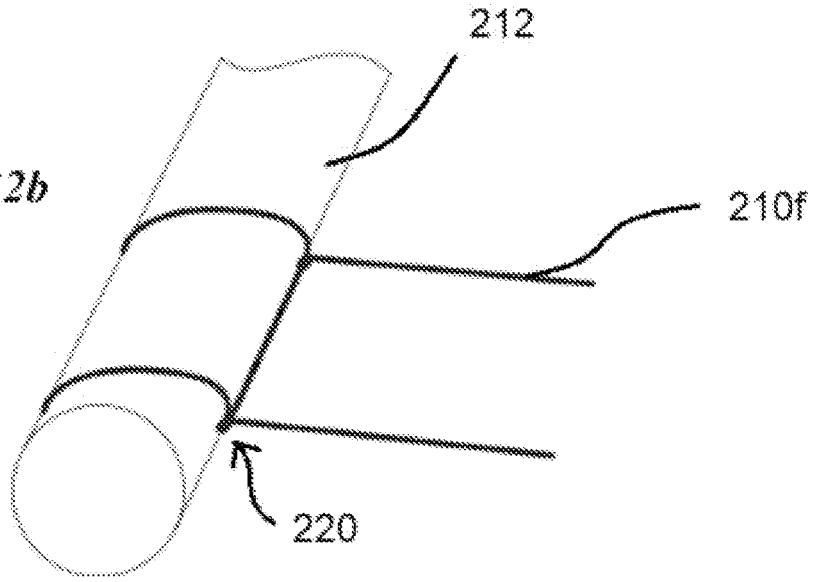

FIGS. 32*a* and 32*b* illustrate the connection of the second filament to the spool by a "hooked in English rib" stitch or a "false English rib" stitch.

Furthermore, when used, terms, such as "first", "second", "higher", "lower", "main", and "secondary" do not necessarily identify an order, relationship priority, or relative position, but they can simply be used to distinguish different components more clearly from one another.

Unless otherwise stated, the measurements and data reported in this text shall be considered as performed in International Standard Atmosphere ICAO (ISO 2533:1975).

With reference to the figures, the reference number 21 globally denotes the modular chair fabric according to the invention.

The fabric 21 is preferably used with a modular chair 1 as described below. However, the fabric 21 can be used in any chair that comprises at least one frame and one support structure including, for example, tubular elements. In fact, the fabric 21 can be used on any chair in the current state of the art.

In addition, a chair that includes the fabric 21 may also include an insert 100.

The insert 100 is also preferably used with a modular chair 1 as described below. However, the insert 100 can be used in any chair that comprises at least one frame and one support structure including, for example, tubular elements. In fact, the insert 100 can be used on any chair in the current state of the art.

The term chair refers preferably to a chair. In any case, the chair could be any device that enables a user to sit and that can, depending on the configuration, also constitute, therefore, devices other than a chair, such as an armchair or a sofa.

For example, the chair may also be a seat for a vehicle, such as a car, or other means of transport, such as trains or aircraft.

In addition, the chair is not restricted to a specific use and design, but can be adapted, as convenient, to uses of various kinds such as home use, in the office, or in other environments other than those mentioned: for example, restaurants, hotels, conference rooms, study rooms, or the like.

In particular, the modular chair 1 preferably comprises at least one resting portion 2.

The resting portion 2 is preferably suitable to allow a user to rest on it. Therefore, it is substantially the part of the chair 1 that can accommodate at least part of the user's body.

The resting portion 2 preferably includes, then, a frame 20 and the fabric 21.

The fabric 21 may be defined by a sheet of fibre only, or it can also include padding elements, for example trapped between two strips of fabric.

Preferably, in any case, the fabric 21 defines a surface 210 and a perimeter area 211.

The surface 210 is preferably suitable to support the user in use. Therefore, preferably, it defines the support surface for said user and is suitable to support the weight force of the user.

The perimeter area 211 is instead substantially defined by the edges of the surface 210. In other words, the perimeter area 211 is substantially defined by the boundary zone of the surface 210.

In addition, the fabric 21 can include composite fibres, i.e. polymeric filaments around which fabric filaments are twisted. This type of fibre allows the fabric to be reinforced or, more generally, the local mechanical properties of the fabric 21 to be modified at will. The term "local properties" means that the surface 210 can be considered as a set of smaller surfaces each defining its own mechanical properties and which can, therefore, vary from surface to surface.

In substance, the conformation of the fabric 21 can be achieved by means of studies and processes such as, for example, finite element theory or other types of methods allowing the surface to be discretized and the local mechanical properties of the discretized elements to be controlled.

Preferably, the fabric 21 is made by automated knitting machines and in particular by machines known as flat bed knitting machines.

With these machines it is possible, as already mentioned, to control the mechanical properties of the discrete elements of the surface 210 in such a way as to allow the fabric 21 to get the desired characteristics according to the structural elements interacting with it in the chair 1.

The fabric 21 can also be made with conventional weaving machines.

In this case, for example, the fabric 21 may show different mechanical properties within the surface 210, for example, depending on the thread count or weft adopted within the fabric 21.

The fabric 21 may also, whether it is made with computerised technology or with conventional textile technology, include localised support elements. For example, the fabric 21 may include within its metal structures, such as bars or filaments, trapped or woven inside pockets that can be easily made in the fabric 21, so as to locally increase the rigidity of the surface 210. In this sense, the fabric 21 may appear as a woven surface 210 including ribs or diaphragms, e.g. metallic, suitable to reinforce the structure of said fabric 21.

In the preferred embodiment, the fabric 21 is made by combining two different weaving methods. In fact, it is preferably made by combining the techniques of knitted weave with that of weaving. Specifically, the fabric 21 includes, at the surface 210, a periodic weave the base of which comprises at least one main knit woven filament 210*c*.

In addition, the surface 210 preferably includes at least one localised area 210*b* where the fabric 21 comprises a periodic weave the base of which also comprises at least one secondary filament or secondary yarn 210*f* woven into a knitted fabric.

The localised areas 210*b* are, thus, basically, preferably knit areas where weft filaments are inserted. Thus, the fabric 21 is, basically, preferably a hybrid fabric including a knit structure inside of which secondary filaments 210*f* are inserted in a weft using the techniques of woven stitching combined with the technique of knitting. These secondary filaments 210*f* are preferably inserted inside the knitted fabric so as to be woven at least between two adjacent rows of main filament 210*c* along a predetermined trajectory. As is well known, the periodic weaves that compose a knitted fabric can be basically defined by continuous, mutually woven rows in succession comprising at least one main filament 201*c*.

However, the insertion of the secondary filament 210*f* can be made using a principle other than weaving. For example, the main yarn 210*c* can be processed in such way as to form a double layer. The secondary yarn, therefore, can be woven, for example alternately, with the two knit layers, or the secondary woven yarn 210*f* may not be woven into the knitted fabric but simply inserted between the layers when the knitted fabric has two layers front and back.

In general, therefore, the fabric 21 basically includes at least one main yarn 210*c* defining a knitted weave inside of which, according to embodiments that may be different, at least one secondary yarn 210*f*, arranged in a weft i.e. along a predetermined trajectory, is inserted.

In the FIGS. 21*a*, 25*a*, and 25*b* an example of a preferred weaving of the fabric 21 is shown. The adjacent rows of main filament 210*c* of the knitted fabric define loops 201*d* basically arranged along a direction named the pick 210*e*. The latter preferably defines the predetermined trajectory of the secondary filament 210*f*. The secondary filament 210*f* of the weft is preferably arranged adjacent to the loops 201*d* and passes between the weave defined by the main filament 201*c* and the pick 201*e*. Specifically, the secondary filament 210*f*, in the localised area 201*b*, is woven with two adjacent rows of the main filament 201*c* and the adjacent rows of the main filament 210*c* define, thus, woven meshes through which the secondary filament 210*f* passes.

In particular, the secondary filament 210*f* is, thus, preferably woven with the main filament 210*c* in such a way that it passes on the front and back of the mesh of loops 201*d*, in every loop 201*d* or every two loops 201*d*, as in FIG. 21*b*. In general, the secondary filament 210*f* is preferably woven with the main filament 201*c* along the pick 210*e*, but could also be woven with the main filament 201*c* in other directions. Of course, the weave could include a plurality of secondary filaments 210*f*, for example, along the direction of the pick 201*e*.

In order to obtain the results described above, in terms of insertion of the weft into the knitted weave, processing can be employed that involves the weaving of the main yarn 210*c* about the secondary yarn 210*f* continuing to change, alternately, the positions of the needle behind and in front, i.e. corresponding, respectively, to the obverse face and to the reverse face, on the knit processing machine. In this way, the main filament 210*c* forms the knits that are basically wound about the secondary filament 210*f* so as to block it.

Specifically, in addition, the secondary filament 210*f* can be inserted inside the knitted weave defined by the main filament 210*c*, even at the same time as the needle processing, by means of a thread-guide. The thread-guide, known in itself by the person skilled in the art, can thus position the secondary filament 210*f* inside the weave, while the latter is formed.

The thread-guide can also be configured to position a plurality of secondary filaments 210*f* in the weave.

In a second embodiment, the secondary filament 210*f* is introduced inside the loops 201*d* along the pick 210*e* defined by the loops 201*d* themselves and, therefore, is hidden inside the surface 210 defined by the fabric 21 at the localised area 210*b*. In addition, the loops 201*d* aligned between two adjacent rows of main filament 201*c* of knitted fabric can include a single weft secondary filament 210*f* along the pick 201*e*, or a plurality of weft secondary filaments 210*f*.

In this way, for example, several localised areas 210*b* can be formed with specific properties depending on the position that the localised areas 210*b* assume in relation to, for example, the seat or the backrest of a chair, for example the chair 1. As already mentioned, the secondary filament 210*f* could be basically also woven between two knit layers. The secondary filament 210*f* could, therefore, be embedded between two layers each defining a weave the base of which is defined by the main filament 201*c*. In addition, the secondary filament 210*f* could be woven, for example alternately, with two layers, as shown in FIG. 26C, or it could be inserted between two layers defining a basically sandwich structure, as shown in FIGS. 26*a* and 26*b*. Even the knitted weave of the main filament 210*c* could define a plurality of tubular portions within which one or more secondary filaments 210*f* are inserted, as shown in FIG. 27.

The secondary filament 210*f* preferably defines mechanical characteristics that are different to the main filament 210*c*. For example, the secondary filament 210*f* can be more or less rigid compared to the main filament 201*c* in such a way as to increase the local elasticity or rigidity of the fabric 21 at the localised areas 210*b*. The secondary filament 210*f* could, alternatively, also define thermal or electric properties other than those of the main filament 201*c*. In this sense, for example, the main filament 210*f* could also be a filament with mechanical properties similar to the main filament 201*c*, but more or differently reactive to heat, rather than to the passage of an electrical current. For example, the secondary filament 210*f* could include piezoelectric material designed to vary the shape as a result of the passage of a current inside or also a material that enables the secondary filament 210*f* to be lengthened or shrunk proportionally to the application or withdrawal of heat.

In any case, the secondary filament 210*f* and the main filament 201*c* are preferably firmly connected together at the perimeter area 211 of the fabric. By firmly connected, we refer to the fact that, while the secondary filament 210*f* and the main one 210*c* are mutually slidable in the weave or overlapping area defined in the localised area 210*b*, at the perimeter area 211, they are linked together in such a way as not to be loose in relation to each other. This bond can be obtained by sewing or gluing or thermally welding the filaments 210*f*, 210*c* at two fixed points arranged in the perimeter area 211, or also by means of methods described below.

This last characteristic, basically makes it possible to improve the efficacy of the weft's operation knitted fabric.

Preferably, the frame 20 defines, in use or, in other words, when assembled, a closed structure. As a result, the frame 20 extends along a curved trajectory in such a way as to close on itself and form a hole, as is the case with a ring.

The frame 20 does not necessarily have a structure formed of planar portions, but preferably has a complex structure that extends in space in a three-dimensional manner, as shown in particular in FIGS. 2, 4 and 8.

A complex structure of this type is, for example, a composite 3D curve, i.e. a curve made along a trajectory that rotates around at least two main axes in three-dimensional space.

Preferably, the frame 20 defines a condition of use or assembly configuration in which it creates the closed structure and a rest condition or pre-assembly configuration in which it takes a different shape.

In use or in the assembled configuration, the frame 20 is preferably designed to support the fabric 21 under tension at at least part of the perimeter area 211.

The fabric 21 can in fact be fully connected to the frame 20 along its perimeter area 211 or can be only partially connected along its perimeter area 211, for example in the case of defining a chair 1 including part of the fabric 21 suspended, as shown in FIG. 12.

This last expedient may also be appropriate in the case of making the chair 1 with different fabrics 21. In fact, the chair 1 could comprise fabrics 21 partly connected to the frame 20 in the perimetric portions and partly connected to other fabrics to make the resting portion 2.

In particular, the frame 20 locally tensions the fabric 21 in relation to the shape taken by said frame 20.

In the rest condition or pre-assembly configuration, instead, the frame 20 can release the fabric 21.

In order to achieve this, the frame 20 preferably, but not necessarily, comprises at least two parts 200.

The parts 200 are portions of frame 20 which may substantially coincide with sections of the closed structure defined by the frame 20. Preferably, they are mutually separate and mutually loosely connected at two fixed points. Alternatively, they can be parts of a single piece defining loose points between the parts 200 allowing the individual parts 200 to be identified. In the latter case, the fixed points correspond to the loose points. Preferably, these fixed points correspond to the endpoints of the parts 200, but other points, e.g. intermediate, may be provided so as to form annular shapes with irregular edges.

Preferably, the parts 200 are loosely connected to each other by means of two hinges 201.

The hinges 201 are preferably the means allowing the switching of the conditions or configurations of use (assembly) or rest (pre-assembly) of the parts 200 i.e. of the frame 20.

These hinges 201 are preferably mechanical.

In particular, preferably, the hinges 201 define the configuration of use, or assembly, in which the parts 200 actually form the frame 20 and the configuration of rest, or pre-assembly, in which the parts 200 are reciprocally folded together.

In this way, the overall dimensions of the support surface 2 are reduced when the parts 200, or the frame 20, are in the rest or pre-assembly configuration.

The hinges 201 each preferably define a rotation axis 2*a*. The rotation axis 2*a* lies preferably along the sagittal plane, which divides the closed structure into two substantially identical portions. In use, the sagittal plane contains appropriately the vertical direction.

The rotation axis 2*a* preferably defines the only degree of freedom granted to the parts 200 of the frame 20. Therefore, in principle, the parts 200 are suitable to rotate preferably exclusively around the rotation axis 2*a* of the hinges 201.

Appropriately, the rotation axes 2*a* of the two hinges 201 are aligned with each other. As a result, the frame 20 can be substantially closed or folded, in the rest or pre-assembly configuration, and be reopened by identifying at least one configuration of use, or assembled configuration, corresponding to a stable equilibrium configuration in which the frame 20 tensions the fabric 21.

In particular, said frame 20 tensions the fabric 21 preferably only when the parts 200 are in a configuration of use.

In order to realize the configuration of use, or assembled or stable equilibrium configuration, the chair 1 according to the invention is preferably configured to allow mutual rotation of the parts 200 in one direction only. In particular, the reciprocal rotation permitted is preferably opposite to the ground, so as to allow the frame 20 to oppose a possible force weight of a weight or user placed on the resting portion 2.

The term rotation opposite to the ground means that, when the frame 20 is opened like a book, it faces the ground in the same way as a book would allow its pages to face the ground, once opened.

In this sense, preferably, the chair 1 provides, in a first embodiment example, a particular configuration of the hinges 201.

In detail, and as shown in FIGS. 5*a*, 5*b* and 7, each of the hinges 201 includes interference portions 201*a*.

The interference portions 201*a* are preferably mutually interfering only when the parts 200 realize the frame 20 in the configuration of use. In addition, they are oriented in such a way that when the user is resting on the support surface 210, the interference portions 201*a* provide a mutual interference force proportional to the user's weight force.

In other words, the interference portions 201*a* may be shoulders designed to collide when the frame 20 is in use and the parts 200 are placed in a position of stable equilibrium and the interference force may be the connecting reaction interacting between the interference portions 201*a* facing each other.

Appropriately, the parts 200 achieve the stable equilibrium position thanks to the interference portions 201*a*.

In a more complex configuration, the hinges 201 may not be mechanical hinges, for example such as domestic door hinges, but may be hinges 201 suitable to allow the looseness of the parts 200 with elastic deformation.

In this context, the parts 200, could even be, as already mentioned, part of a single piece closed and suitable to be folded in certain fixed loose points. Application examples such as these are present, for example, in bearing-less systems where the permitted movements of a hinge can be delegated to deformations of the material instead of to the mechanical connections of the structure.

In addition, the hinges 201 could also envisage locking means suitable to mutually lock the parts 200, when in the configuration of use or assembled, so as to ensure that they continue to keep the fabric 21 taut.

Alternatively, the hinges 201 may include an elastic element, such as a spring, to keep the parts 200 in the configuration of use or assembled, if not stressed. In the latter case, the locking devices could be configured to lock the parts 200, and therefore the frame, in the rest or pre-assembly configuration.

Or the interference portions 201*a* could, instead, themselves comprise locking means. For example, the latter could include a pressure lockable elastic mechanism suitable to block rotation around the hinge 201 as soon as the interference portions 201*a* collide. In addition, this mechanism could allow the release of the parts 200 and the release of the hinges 201 when pressed again. An example of this type could be a locking mechanism with a spring presser.

The fabric 21, as mentioned above, is connected to the frame 20 preferably along at least part of its perimeter area 211.

In particular, preferably, the frame 20 defines a guide 202.

The guide 202 is preferably a hollow guide that continues along at least each of the parts 200. In particular, preferably, the guide 202 substantially takes the shape of a track through which elements, such as rigid elements, compatible with the dimensions of the guide 202, can pass.

Examples of this type are described, for example, in the U.S. Pat. No. 2,839,126 patent application, incorporated herein as reference, in column 1 lines 62-72 and column 2 lines 1-12.

In substance, the guide 202 may thus also include access holes that allow objects to be inserted inside said guide 202.

These holes may be located, for example, in predetermined points of the frame 20 such as, for example, the fixed points at the ends of parts 200. Preferably, the access holes are located in the upper area of the frame 20 relative to the ground so that objects can be inserted from top to bottom, as shown in FIG. 8. Preferably, the access holes are facing the ground so as to be concealed from a user observing the chair 1 in the configuration in which it is to be used or assembled.

The fabric 21 then preferably includes at least one spool 212.

The spool 212 may be defined by a reinforced portion of fabric 21, or by a portion of fabric 21 of greater thickness and/or density, or it may be defined by an element external to the fabric 21 and attached to said fabric 21.

Preferably, in any case, the spool 212 is placed along the perimeter area 211 and is designed to be inserted inside the guide 202.

In the preferred embodiment of the fabric 21, wherein the latter is formed by means of coupling a secondary woven filament 210*f* within one or more knit layers defined by a periodic weave the base of which is defined by a main filament 210*c*, the spool 212 can be a long element trapped inside part of the fabric 21 at the perimeter area 211.

Therefore, the main filament 210*c* can preferably form a tubular structure designed to accommodate the spool 212. Of course, the fabric 21 could also just be simply joined to the spool 212 by means of methods such as stapling or gluing or other.

In addition, the secondary filament 210*f* is preferably connected to the main filament 210*c*, especially to the spool 212. In this regard, the secondary filament 210*f* is preferably inserted inside the fabric 21 in such a way as to make at least one almost complete turn about the spool, as shown in FIGS. 25*a*-26*c*. Therefore, the secondary filament 210*f* is preferably wound about the spool 212.

In particular, the secondary filament 210*f* can also totally wrap around the spool 212, as in FIGS. 25*a*, 26*b*, and 26*c*, or partially wrap around it as in FIGS. 25*b* and 26*a*, basically defining double secondary filament 210*f* wefts as given, for example, by the entry of the secondary filament 210*f* into the tubular structure of the fabric 21, accommodating the spool 212, and the subsequent exit.

The winding of the secondary filament 210*f* on the spool 212 has the effect of blocking the main filament 210*c* and the secondary filament 210*f* together at the spool 212.

The arrangement of the secondary filament 210*f* in a weft can follow, in addition, a plurality of paths. FIG. 28 represents, for example, a pattern of the localised area 210*b* of a fabric wherein the weft, i.e. the secondary filament 210*f*, is arranged within the knitted weave following a continuous path.

The path can, therefore, as shown in a simplified way in the diagrams in FIGS. 29*a*-29*c*, be described by arranging the secondary filament 210*f* so as to wrap, with one complete turn, the spool 212, and then proceed within the knitted weave defined by the main filament 210*c*, and wrap again around a spool 212 arranged on the opposite side to the previous spool 212. In order to pass to one row, or pick 210*e*, lower or upper, the secondary filament 210*f* proceeds parallel to the spool 212 to then wrap again on this and weave itself again with the main filament 210*c* until reaching the starting spool 212. Of course, this procedure can involve, along some picks 210*e*, the introduction of one secondary filament 210*f* or even of a third or more secondary filaments 210*f*.

Even more specifically, the secondary filament 210*f* can be connected to the spool 212 by a "hooked in English rib" stitch or "false English rib" stitch 220 as usually happens between the filament and the needle working the knitted fabric. For example, the secondary filament 210*f* can be connected to the spool 212 by a "false English rib" stitch as usually happens between the filament and the needle working the knitted fabric. In addition, the secondary filament 210*f* can be dragged next to the spool 212, to pass from one pick 210*e* to the other, or it can be inserted inside the spool 212 itself if this latter is a tubular element.

Returning to the structure of the frame 20, the guide 202 is preferably designed to enable the spool 212 to slide inside of it. In detail, the guide 202 is configured to trap at least part of the slider 212 in order to attach the fabric 21 and the frame 20 together.

The spool 212 can therefore be made continuously along the perimeter area 211 of the fabric 21 or the fabric 21 can provide a plurality of consecutive spools 212.

Preferably, the frame 20 is substantially a cornice for fabric 21 inside which the fabric can be placed by sliding of the spool 212 in the guide 202. A similar mechanism is also described in the patent application U.S. Pat. No. 6,293,624, incorporated herein as reference, in column 3 lines 26-52.

However, preferably, the guide 202 is accessible only from the bottom of chair 1, i.e. from the ground, and the fabric 21 is connected to the frame 20 in such a way as to wind around at least part of the frame 20.

In this way, not only is the connection between the frame 20 and the fabric 21 concealed from the user, but in addition the frame 20 itself is covered with the fabric 21 and the tension is further ensured by the winding of the fabric 21 around the frame 20.

The parts 200 may then be different, or they may be identical and mirror each other in relation to the rotation axes 2*a*.

This last example is preferable especially so as to optimize the production of the parts 200. The latter are, in fact, preferably made of aluminium by means of three-dimensional extrusion. Obviously, the parts 200 could also be made of polymeric material, for example also extruded, or other materials allowing the creation of hollow and continuous profiles with a non-coplanar extension path. In another type of embodiment, the parts 200, and therefore the frame 20, could be made using a composite structure, for example including a metal core covered with a different material, such as a polymeric material, for example by means of technologies such as polymer injection moulding on a metal core.

The non-coplanar aspect however, remains an element which is not necessary, but preferable for making the chair 1, especially with regard to the comfort provided by it.

The chair 1 comprises, in addition to the resting portion 2, also a load-bearing portion 3.

The load-bearing portion 3 is preferably designed to support the resting portion 2 suspended and permanently spaced from the ground. For example, a typical load-bearing portion 3 included in conventional chairs is made up of four, or fewer, support legs.

Otherwise, but not necessarily, the load-bearing portion 3 is preferably made of a tubular structure that can be connected to the resting portion 2. More generally, the load-bearing portion 3 includes attachment means 30.

The attachment means 30 are preferably suitable for detachably and stably connecting the resting portion 2 and the load-bearing portion 3.

These attachment means 30 are preferably interlocking connections suitable to connect the portions 2 and 3 in predetermined fixed points so as to make the chair 1.

More specifically, the frame 20 includes protuberances 22.

The protuberances 22 preferably protrude towards the ground. The protuberances 22 are for example cylindrical elements which protrude from the frame 20 to interact with other external components.

These protuberances 22 are therefore preferably, in turn, connected to the frame 20 by means of known fastenings such as nails, bolts or other types of joint. Alternatively, the protuberances 22 could be made directly on the frame 20.

The protuberances 22 may therefore be made of metallic or, preferably, polymeric material. For example, the protuberances 22 can be made using injection moulding technology.

The attachment means 30 are, then, suitably configured to interact with the protuberances 213. In particular, preferably, the attachment means 30 include holes 31 structurally configured to accommodate the protuberances 22 so as to permanently block the resting portion 2 onto the load-bearing portion 3. In particular, preferably, the chair 1 is configured in such a way that the weight of the resting portion 2 and, possibly, of a weight or user placed on it, tends to keep the resting portion 2 and the load-bearing portion 3 connected to each other and permanently locked.

The load-bearing portion 3, as mentioned above, does not necessarily define a structure as described above, but may also include a conventional configuration, e.g. cantilevered, four-legged or other configuration, provided that it includes attachment means 30 suitable to allow the coupling of the resting portion 2 and the load-bearing portion 3. In an alternative configuration of the chair 1, the parts 200 may comprise two guides 202 each, as shown in FIG. 9*b*. In this case, for example, the chair 1 can be configured in such a way as to trap two different fabrics 21, one of which can be used to make the resting portion 2, and the other to cover the bottom of the chair, as explicitly shown in FIGS. 10 and 13*b*. The second guide 202 could also allow the connection, by interlocking, of a coupling device 5, as shown in FIGS. 9*b* and 13*c*.

The coupling device 5 could be, for example, a body shell provided on the bottom, in relation to the ground, of the resting portion 2 in such a way as to support it, through the connection in the second guide 202, concealing part of the bottom of the chair 1, and allowing the connection of the resting portion 2 to any type of load-bearing portion 3. In fact, the coupling device 5 could have its own rigidity, for example, given by the fact that it is made of a metal or polymer structure, such as to allow the coupling of the resting portion 2 to the load-bearing portions 3 such as the wheel supports of typical office chairs, as shown in FIG. 11.

As a result, the coupling device 5 may be counter-shaped to the lower portion of the frame 20 and, in particular, may have an edge counter-shaped to the second guide 202 and may be counter-shaped to the final shape of the surface 210 of the fabric 21 of the resting portion 2. Obviously, the coupling device 5 may include articulation mechanisms of the resting portion 2 known in the state of the art. Mechanisms of this type are known, for example, by the term Synchro-tilt.

The chair 1 preferably comprises, in addition, a stretcher 4.

The stretcher 4 may be part of the load-bearing portion 3 and integrated inside it or it may be an external element.

Preferably, the stretcher 4 is configured to tension the support surface 210 along predetermined fixed points so that the fabric 21 defines at least two specific areas, or even more. Preferably the fabric 21, when stretched, defines a backrest 21*a* and a seat 21*b*.

The seat 21*a* is preferably placed adjacent to the support portion 3, while the backrest 21*a* is spaced from it and is suitable to accommodate the user's back. In particular, the stretcher 4 is capable of exerting a greater tension on the seat 21*a*. The seat 21*a* therefore includes a support surface 210 that is subject to greater tension than, for example, the backrest.

The presence of the stretcher 4 is not strictly necessary for the use of the fabric 21 on a frame 20. The fabric 21 could, in fact, be laid on any chair, including, preferably, a frame 20 at least provided with a guide 202, as represented, for example, in FIG. 23.

The fabric 21 is preferably connected to a frame 20 through the spool 212 and the guide 202 so as to be placed under tension. In particular, the fabric 21 is attached to the frame 20 so as to be firmly attached at least in the perimeter area 211. This characteristic, clearly visible in FIG. 22, is important since the coupling of the frame 20 and the fabric 21 carried out thus means that the fabric 21 does not move on the frame 20, delocalising the localised areas 210*b* and rendering futile the mechanic effects provided by the fabric 21.

In fact, the chair that includes the fabric 21, like the chair 1, preferably defines particular configurations.

The localised areas 210*b* are preferably arranged in predetermined points of the backrest 21*a* and of the seat 21*b*. In particular, the fabric 21 that forms the backrest 21*a* preferably includes three localised areas 210*b*.

A first localised area 210*b* is arranged at the lumbar area of the user when seated; a second localised area 210*b* is preferably arranged at the high part of the thoracic spine of the seated user; and the third localised area 201*b* is arranged between the first and the second localised area 210*b*.

In particular, the first localised area 210*b* and the second localised area 210*b* preferably include second filaments 210*f* with high elasticity so that these localised areas 210*b* can be deformed.

The third localised area 201*b* preferably includes at least one rigid second filament 210*f* in such a way that the localised area 210*b* is more rigid, at least compared to the other two localised areas 201*b*, and cannot easily be deformed.

In this way, when the user sits in the chair, the fabric 21 conforms to the lumbar portion and thoracic spine of the user's body even though the structure of the frame 20 is not necessarily shaped in this way. In fact, the load-bearing is tasked to the fabric 21 and the shape of the surface 210 defines, with the localised areas 201*b*, the shape that the chair can assume at least at the backrest 21*a*, as shown in FIG. 24.

The same issue can be addressed, for example, for the seat 21*b*. For example, the seat can be provided with more pliable side walls, thus defining localised areas 210*b*, and a more rigid central resting area, for example similar to the third localised area 210*b* of the backrest 21*a* or even more rigid, for example with more secondary filaments 210*f* arranged along the pick 210*e*.

In general, therefore, the localised areas 210*b* are more or less elastic or rigid in relation to the type or number of secondary filaments 210*f* inserted within the base comprising the main filament 210*c*.

The stretcher 4 preferably includes a tubular element 40.

The tubular element 40 can therefore be hollow or solid. Preferably it is U-shaped, or C-shaped, and is suitable to exert a tension on the support surface 210 along its extension.

The support surface 210 can thus be placed between the stretcher 4 and the ground so that the stretcher 4 tensions the fabric 21 directly towards the ground.

Preferably, the support surface 210 includes a pocket 210*a*.

The pocket 210*a* is preferably configured to accommodate at least part of the tubular element 40. In this way, the tubular element 40, when subjected to movements, moves part of the fabric 21 with it.

Depending on the shape of the pocket 210*a*, moreover, the fabric 21 is also only strained along the attachment points of the tubular element 40 to the pocket 210*a* or, if the pocket 210*a* completely covers the tubular element 40, the fabric 21 is strained along the entire extension of the tubular element 40.

In this configuration, preferably, the tubular element 40 is placed below the fabric 21 with respect to the ground, and inside the pocket 210*a* made on said fabric, as shown in FIG. 2.

In addition, the load-bearing portion 3 may include second protuberances 32.

The second protuberances 32 are preferably of the same type as the protuberances 22 and perform substantially the same function.

In fact, preferably, the second protuberances 32 are housed inside the tubular element 40 and the latter is thus configured to house them.

In addition, the load-bearing portion 3 includes connection means 33.

The connection means 33 are preferably configured to lock the tubular element 40 in a predetermined position towards the ground, in which the stretcher 4 subjects the support surface 210 to continuous tension.

Appropriately, the connection means 33 are substantially interlocking means suitable to trap at least part of the stretcher 4 in such a way that it can remain permanently placed in a predetermined position, exercising its action in a continuous manner, as mentioned.

In detail, the stretcher 4 can also define a curvature, or concavity towards the ground. The latter can, in fact, facilitate the coupling between the connection means 33 maximising their stability given that the stretcher 4, once the user has sat on the resting portion 2, exerts a force consistent with the locking direction of the connection means 33.

The resting portion 2, and in particular the seat 21*b* and backrest 21*a*, is obtained mainly thanks to the stretcher 4. However, the configurations of the frame 20 and fabric 21 also contribute significantly to the technical aspects of the resting portion 2, for example, thanks to the different rigidity that the fabric 21 can have, thanks in part to the shape of the frame 20.

As said, the production technique of the fabric 21, by means of machine knitting, allows the density and conformation of the fabric 21 to be controlled locally.

In addition, the shape of the frame 20 can enable, and preferably does enable, the fabric 21 to be subjected to different tensions along its perimeter area 211.

In particular, the frame 20 takes a preferably three-dimensional eight shape with the portion reserved for the seat 21*b* broader than the portion reserved for the backrest 21*a*.

In this way, a priori, the fabric 21 is more tensioned in the area reserved for the seat 21*b*. As a result, it is possible to synergistically combine the technological possibilities provided by the fabric 21, frame 20 and stretcher 4, so as to define a support surface 210 controlled in each sector.

For example, the seat 21*b* has a greater rigidity than the backrest 21*a* and therefore a lower deformability.

The operation of the chair 1 described above in structural terms is substantially defined by the procedure for its construction, described below.

The construction procedure comprises a plurality of successive steps, that enable the chair 1 to be made from the individual parts. However, the most important step is the tensioning step. In fact, during the tensioning step, preferably the parts 200 are rotated reciprocally with respect to the rotation axes 2*a* in such a way as to create the frame 20 and tension the fabric 21.

This tensioning step is innovative in that it allows the resting portion 2 to be made without any difficulty and guarantees the correct tensioning of the same in order to make the chair 1.

In addition, the tensioning step can be preceded by an installation step in which the fabric 21 is connected to the frame 20. In particular, the spool(s) 212 of the surface 210 are preferably inserted inside the guides 202 of the parts, for example through a specially cut slit at the ends of the parts 200, and the fabric 21 is then connected at the perimeter area 211 to the frame 20.

Aside from the above steps, the process includes other relevant steps that may complement or replace the previous step.

For example, a preferred manufacturing process of the chair 1, may include a resting portion 2 defined in the tensioning step and possibly the installation step.

Alternatively, the manufacturing process may include a resting portion 2 including, initially, the frame 20 and the fabric 21 properly reciprocally connected with the tensioned fabric 21.

The procedure may then comprise a connection step in which the load-bearing portion 3 and the resting portion 2 are mutually connected.

In particular, preferably, the connection step consists of inserting the protuberances 22 inside the holes 31 of the attachment means 30.

In addition, the process may advantageously include a further shaping step in which the stretcher 4 is connected to the resting portion 2 and to the load-bearing portion 3 and tensions the surface 210.

More in detail, preferably, the tubular element 40 of the stretcher 4 is inserted inside the pocket 210*a* made on the surface 210 and is then connected by inserting the second protuberances 32 inside the ends of it.

Once the stretcher 4 is attached to both portions 2, 3 it is preferably juxtaposed to the ground and locked by the connection means 33 which allow the tubular element 40, and thus the stretcher 4, to be kept in a position such that the fabric 21 is tensioned in predetermined points, As a result, the shaping of the chair 1 allows the backrest 21*a* and the seat 21*b* of the chair 1 to be defined.

As already mentioned, the insert 100 can be part of the modular chair 1 as described above, or it can be designed for other chairs.

In any case, the insert 100 preferably comprises a support structure 101.

The support structure 101 is preferably designed to enable the attachment of the insert 100 to an external support 105.

The external support 105 can be any type of body designed to enable the firm attachment of the insert 100. It can, therefore, be, for example, a tubular element, for example one belonging to the frame of a chair. In this sense, the external support 105 can preferably coincide with the frame 20.

The support structure 101, in addition, preferably defines a main extension direction 101*a*.

The main extension direction 101*a* is preferably the direction along which the support structure 101 extends. In addition, the main extension direction 101*a* is preferably the direction along which the support structure 101 is attached to the external support 105.

The support structure 101 preferably includes, therefore, a coupling zone 102 and a joining zone 103.

The coupling zone 102 is the zone immediately designed to enable the connection with one or more external supports 105, while the joining zone 103 is preferably designed to enable the joining or connection of the support structure 101 to at least one external body 104. Of course, the joining zone 103 could enable the joining of the support structure 101 with a plurality of external bodies 104, just like the coupling zone could enable the coupling with a plurality of external supports 105, such as, for example, shown in FIGS. 20*a* and 20*b*.

The external body 104 is preferably any external element that can be joined to the joining zone 103. The external body 104 is preferably an element that contributes to the covering of a chair, for example like the modular chair 1, and can include useful elements in this sense, such as fabric, padding, or a solid body, such as a body shell.

The external body 104 is preferably one or more of either: fabric, padding, or a solid body.

The insert 100, therefore, preferably comprises, when in use, both the support structure 101 and the external body 104.

The coupling zone 102 preferably defines an open tubular element extending along the main extension direction 101*a*. The open tubular element is basically a tube comprising at least one hole that extends along the main extension direction 101*a*.

For example, if the tubular element is a crossbeam with thin walls, the coupling zone 102 is a crossbeam with thin walls with an open section.

The coupling zone 102 therefore basically defines an open profile that defines a perimetric section 102*b* and a perforated section 102*c*.

The open profile is preferably the shape created by the section of the coupling zone compared to a plane perpendicular to the main extension direction 101*a*.

The perimetric section 102*b* corresponds, thus, basically to the part of the profile created by the walls of the coupling zone 102, while the perforated section corresponds to the free portion of the profile.

In particular, the perforated section 102*c* preferably corresponds to less than 35% compared to the perimetric section 102*b*.

In this way, the coupling zone 102 basically creates a hook for the support structure 101.

The joining zone 103, in contrast, preferably defines a flat surface extending along the main extension direction 101*a*.

The coupling zone 102 is preferably basically circular and, therefore, the support structure 101 basically creates, as a whole, a question mark or hook shape.

The joining zone 103, in this embodiment, is immediately adjacent to the perforated section 102*c*, but could also not be. For example, the joining zone 103 could be attached to the perimetric section 102*b*, far from the perforated section 102*c*.

In any case, as mentioned, the joining zone 103 is configured to enable the insert 100 to be joined to the external body 104.

In this respect, the joining zone 103 can preferably comprise various joining elements while yet remaining within the same inventive concept. For example, the joining zone may comprise eyelets designed to accommodate interlocking elements, such as buttons, or it can include buttons itself, or it can include an adhesive portion, with Velcro, glue, or the like.

The joining zone 103 is preferably a portion that is thin enough to be perforated and can enable a fabric to be sewn onto it.

The support structure 101 therefore comprises at least one joining zone 103; in any case, it could also include two joining zones 103.

In this alternative embodiment, the joining zones 103 are preferably separated from each other by the perforated section 102*c* and attached to the opposite ends of the perimetric section 102*b* respectively.

In this way, the coupling zone 102 can easily house any external support 105, by introducing the latter between the joining zones 103.

In fact, the whole support structure 101 is preferably made of a single piece and includes flexible material. Even more specifically, the support structure 101 includes polymeric material that can be deformed, like rubber. The deformation of the support structure 101 can be exclusively elastic, or it can be partially elastic or plastic, or the support structure 101 could be an element that is wholly, plastically deformable in such a way as to enable its deformation to be maintained and its being shaped as desired, for example, counter-shaping the coupling zone 102 to the external support 105.

The coupling zone 102 advantageously comprises a plurality of first notches 102*a*.

The first notches 102*a* are through holes arranged on the surface of the coupling zone. The notches, therefore, are basically, preferably, arranged in the coupling zone 102 at the perimetric sections 102*b*.

The notches 102*a* are, in fact, preferably perimetric and extend along planes perpendicular to the main extension direction 101*a*.

In this way, the first notches 102*a* are produced to enable the deformation, preferably elastic, of at least part of the support structure 101 and at least the curvature of at least part of the main extension direction 101*a*. Even more specifically, the notches 102*a* enable at least part of the support structure 101 to be easily bent, mainly at the coupling zone 102.

Therefore, the first notches 102*a* preferably extend along at least 70% of the perimetric section 102*b* locally defined by the profile of the section defined by the corresponding plane in the coupling zone 102.

In this respect, the joining zone 103 also preferably comprises a plurality of second notches 103*a*.

The second notches 103*a* also preferably extend along planes perpendicular to the main extension direction 101*a* in such a way as to enable the deformation, preferably elastic, of at least part of the support structure 101 and at least the curvature of at least part of the main extension direction 101*a*.

Specifically, the second notches 103*a* preferably enable the bending, mainly of the joining zone 103.

In addition, the first notches 102*a* and the second notches 103*a* are preferably arranged on the corresponding planes.

In addition, both the first notches 102*a* and the second notches 103*a* can define different shapes. For example, they can define basically straight shapes and define, therefore, straight through-holes along the perimetric section 102*b* and along the flat surface defined by the joining zone 3.

Or, each of the notches 102*a*, 103*a* can define an isosceles triangle shape wherein the vertex of the isosceles triangle is turned towards the joining zone 103 and towards the coupling zone 102, respectively.

The first notches 102*a* are preferably straight, while the second notches 103 create a triangle shape.

The insert 100 can, thus, be used in different configurations.

For example, the insert 100 can be inserted into a chair like the modular chair 1. The chair 1 can, therefore, essentially comprise the insert 100 and the frame 20 where the frame 20 can simply just defined a tubular element.

In this case, therefore, the external support 105 of the insert 100 corresponds to the frame 20. In use, the coupling zone 102 can trap the frame 20 and the support structure 101 is shaped to the frame 20 by locally varying the main extension direction 101*a* if the frame 20 is not straight. Basically, therefore, the deformability of the insert 100 easily enables it to be adapted to any frame 20, for example frames with complex shapes such as that of the chair 1.

In addition, the fact of defining a coupling zone 102 with the above-mentioned proportions and a material that can be deformed enables the frames 20, with normal diameters or sections of different sizes, to be trapped.

As already mentioned, in fact, the insert 100 is preferably made of a deformable material, for example, but not exclusively, polymer. In addition, it is preferably made of a single piece, but could also be made of more pieces joined together.

In a preferred use configuration, the chair 1 comprises a frame 20 that includes some of the features described above. Basically, for example, the frame 20 defines at least one guide 202 and the fabric 21 includes at least one spool 212 designed to be trapped inside the guide 202. The guide 202 is, thus, configured to trap at least part of the spool 212 in order to attach the fabric 21 and the frame 20 together, as already described. In any case, in addition, the guide 202 is configured to trap the coupling zone 102 of the insert 100 in order to attach the insert 100 and the frame 20 together.

In addition, the coupling zone 102 advantageously traps, in turn, the spool 212.

In this way, the guide 202 creates a block able to firmly attach, at the same time, both a fabric 21 and an external body 104.

This feature is fundamentally important when it comes to assembling the fabric on the chair 1. For example, the assembly can consist in joining functional parts of the chair 1 or even in a simple covering.

In fact, the insert 100 enables the implementation of a special procedure for assembling the chair 1.

The assembly procedure may be basically a simple assembly procedure or may basically be a procedure for covering the chair 1.

In particular, the assembly procedure, or covering procedure, comprises at least the coupling steps and insertion steps in order to create the structure described above. In the coupling step, the spool 212 is preferably trapped inside the coupling zone 102 in such a way as to attach the insert 100 together with the fabric 21.

In addition, in the insertion step, the coupling zone 102 is inserted into the guide 202 in such a way as to attach the insert 100 and the frame 20 together so that the chair 1 is at least partially covered both with the external body 104 and with the fabric 21. The external body 104 can, therefore, be a body shell, or an additional fabric or a padding hidden by the fabric 21.

The fabric 21 according to the invention achieves important advantages.

In fact, the fabric 21 makes it possible to define and control the mechanical properties at the localised areas 210*b* without impacting the exterior look of the surface 210.

In fact, the fabric 21 significantly increases the ergonomics of the chair on which it is installed, defining in an accurate and controlled manner the rigidity and elasticity characteristics of the support surface 210.

In addition, the fact that the secondary filament 210*f* of the weft is arranged, preferably, along the pick 210*e* and, for example, between the knitted fabrics along the pick 210*e*, adjacent to the loops 210*d* or inside the loops 210*d*, or, again, between two knit layers, makes it possible to limit the woven end coming out of the fabric 21. Therefore, the user sitting on the chair that includes the fabric 21 does not perceive any discomfort or unevenness in the fabric.

In conclusion, the configurations of the backrest 21*a* and seat 21*b*, which can be made with the fabric 21 and a frame 20 including at least one guide 202, enable the production of chairs that conform to the body of the user during use and that, thus, are not deformed when no user is resting on them. Basically, this last effect is especially significant from the design point of view, since it is no longer necessary to create rigid and curved backrests in such a way as to take on forms suitable for the user's back, but it is the fabric 21 itself, attached by means of the spool 212 to the guide 202, that defines localised release areas 210*b* that are deformed.

In addition, the fabric 21 is compatible with the insert 100.

Variations may be made to the invention that fall within the scope of the inventive concept defined in the claims.

For example, the system of attaching the fabric 21 and the frame 20 could be different and could involve a non-detachable connection between the two. In addition, the guide 202 could be suitable to house a number of adjacent spools 212, as shown in FIG. 9*a*; therefore, the frame 20 could be operationally connected and joined to a plurality of fabrics 21, for example, overlapping.

The insert 100 could, thus, also comprise an intermediate portion 106.

The intermediate portion 106 could be, for example, arranged between the coupling zone 102 and the joining zone 103. It could also be a part of the joining zone 103, not including second notches 103*a*.

In addition, the intermediate portion 106 is preferably a plastically deformable portion. To achieve this deformation, the intermediate portion 106 could comprise grooves designed to reduce the local thickness of the support structure 102, while increasing flexibility, and a plastic core, such as a thin metal. Of course, it is possible to use any material that enables the plastic deformation in such a way as to change the orientation of the joining zone 103 with respect to the coupling zone.

The fabric 21 could, therefore, include one or more additional secondary filaments 210*f* arranged skew in relation to the pick 210*e* in such a way as to create a sort of net.

In this context, all details can be replaced by equivalent elements, and the materials, shapes, and dimensions may be any materials, shapes, and dimensions.

The invention claimed is:

1. A fabric for a modular chair suitable for defining a surface in use, suitable for supporting a user when seated on said chair, and a perimeter area defined by edges of said surface, said fabric including, at said surface, a base comprising at least one main knit woven filament, said surface includes at least one localised area at which said fabric comprises at least one secondary filament inserted inside said base and arranged in a weft along a predetermined trajectory in respect of said at least one main knit woven filament, said at least one main knit woven filament and said at least one secondary filament being mutually and tightly attached at said perimeter area, wherein said fabric includes at least one spool defining a long element trapped inside part of said fabric along said perimeter area in which said at least one main knit woven filament creates on said base a tubular shape suitable for housing said spool, and said at least one secondary filament at least partially wraps said spool in such a way as to mutually block said at least one main knit woven filament and said at least one secondary filament at said spool, and wherein said at least one secondary filament is connected to the spool by a "hooked in English rib" stitch.

2. The fabric according to claim 1, wherein in said localised area said at least one secondary filament is woven with two adjacent rows of said at least one main knit woven filament and said adjacent rows of said at least one main knit woven filament define woven meshes and a plurality of loops arranged in one direction called a pick, said pick defining said predetermined trajectory and said at least one secondary filament being introduced within said woven meshes adjacent to said loops along said pick.

3. The fabric according to claim 2, wherein said woven meshes or said loops include a plurality of said at least one secondary filament along said pick.

4. The fabric according to claim 3, wherein said fabric includes, in said localised area, two layers each including the base comprising said at least one main knit woven filament, and said at least one secondary filament is embedded between said layers.

5. The fabric according to claim 4, wherein said at least one secondary filament is alternately woven into said layers or said at least one secondary filament is inserted between two layers defining a basically sandwich structure.

6. The fabric according to claim 1, wherein in said localised area said at least one secondary filament is woven with two adjacent rows of said at least one main knit woven filament and said adjacent rows of said at least one main knit woven filament define a plurality of loops arranged in one direction called a pick, said pick defining said predetermined trajectory and said at least one secondary filament being introduced into said loops along said pick.

7. A modular chair comprising at least one resting portion suitable for allowing a user to rest on the resting portion and including a frame and a fabric according to claim 1, said frame being suitable for supporting said fabric under tension in at least part of said perimeter area.

8. The chair according to claim 7, wherein said frame defines at least one hollow and continuous guide configured to trap at least part of said spool to attach said fabric and said frame together.

9. The chair according to claim 7, wherein said fabric defines at least one backrest and one seat and said surface includes a plurality of said localised areas arranged at predetermined points on said backrest and said seat, said localised areas being more or less elastic or rigid in relation to the type or number of said at least one secondary filaments inserted within said base comprising said at least one main knit woven filament.

10. The chair according to claim 9, wherein said backrest includes a first said localised area arranged at the lumbar area of said user when seated, a second said localised area arranged at the top of the thoracic spine of said user when seated, and a third said localised area arranged between said first localised area and said second localised area, said first localised area and said second localised area including said second filaments that are elastic and said third localised area including said second filaments that are more rigid than said second filaments of said first and second localised areas.

11. A fabric for a modular chair suitable for defining a surface in use, suitable for supporting a user when seated on said chair, and a perimeter area defined by edges of said surface, said fabric including, at said surface, a base comprising at least one main knit woven filament, said surface includes at least one localised area at which said fabric comprises at least one secondary filament inserted inside said base and arranged in a weft along a predetermined trajectory in respect of said at least one main knit woven filament, said at least one main knit woven filament and said at least one secondary filament being mutually and tightly attached at said perimeter area, wherein said fabric includes at least one spool defining a long element trapped inside part of said fabric along said perimeter area in which said at least one main knit woven filament creates on said base a tubular shape suitable for housing said spool, and said at least one secondary filament at least partially wraps said spool in such a way as to mutually block said at least one main knit woven filament and said at least one secondary filament at said spool, and connected to the spool by a "false English rib" stitch.

12. A modular chair comprising at least one resting portion suitable for allowing a user to rest on the resting portion and including a frame and a fabric according to claim 11, said frame being suitable for supporting said fabric under tension in at least part of said perimeter area.

13. The chair according to claim 12, wherein said frame defines at least one hollow and continuous guide configured to trap at least part of said spool to attach said fabric and said frame together.

14. The chair according to claim 12, wherein said fabric defines at least one backrest and one seat and said surface includes a plurality of said localised areas arranged at predetermined points on said backrest and said seat, said localised areas being more or less elastic or rigid in relation to the type or number of said at least one secondary filaments inserted within said base comprising said at least one main knit woven filament.

15. The chair according to claim 10, wherein said backrest includes a first said localised area arranged at the lumbar area of said user when seated, a second said localised area arranged at the top of the thoracic spine of said user when seated, and a third said localised area arranged between said first localised area and said second localised area, said first localised area and said second localised area including said second filaments that are elastic and said third localised area including said second filaments that are more rigid than said second filaments of said first and second localised areas.

* * * * *